US007274351B2

(12) United States Patent
Washio et al.

(10) Patent No.: US 7,274,351 B2
(45) Date of Patent: Sep. 25, 2007

(54) DRIVER CIRCUIT AND SHIFT REGISTER OF DISPLAY DEVICE AND DISPLAY DEVICE

(75) Inventors: Hajime Washio, Sakurai (JP); Shunsuke Hayashi, Onomichi (JP)

(73) Assignee: Sharp Kabushiki Kaisha, Osaka (JP)

( * ) Notice: Subject to any disclaimer, the term of this patent is extended or adjusted under 35 U.S.C. 154(b) by 897 days.

(21) Appl. No.: 10/446,149

(22) Filed: May 28, 2003

(65) Prior Publication Data

US 2003/0234761 A1 Dec. 25, 2003

(30) Foreign Application Priority Data

May 30, 2002 (JP) ..... 2002-158124
May 19, 2003 (JP) ..... 2003-140367

(51) Int. Cl.
*G09G 3/36* (2006.01)

(52) U.S. Cl. ..... 345/100; 345/98; 345/99

(58) Field of Classification Search ..... 345/87–100, 345/204–214

See application file for complete search history.

(56) References Cited

U.S. PATENT DOCUMENTS 5,686,936 A 11/1997 Maekawa et al.
6,693,616 B2 * 2/2004 Koyama et al. ..... 345/98
6,693,617 B2 * 2/2004 Sasaki et al. ..... 345/98
6,724,361 B1 * 4/2004 Washio et al. ..... 345/98
6,909,417 B2 * 6/2005 Washio et al. ..... 345/98
2005/0179635 A1 * 8/2005 Murakami et al. ..... 345/100

FOREIGN PATENT DOCUMENTS

CN 1298169 A 6/2001
EP 0 984 423 A2 3/2000
JP 11-218738 A 8/1999
JP 2000-206791 A 7/2000
JP 2001-5432 A 1/2001

OTHER PUBLICATIONS

Chinese Office Action and English translation thereof mailed Nov. 4, 2005 in corresponding Chinese application No. 03138299.1.
U.S. Appl. No. 09/703,918, filed Nov. 1, 2000 entitled "Shift Register and Image Display Device".
U.S. Appl. No. 09/578,440, filed May 25, 2000 entitled "Shift Register and Image Display Apparatus Using the Same".

* cited by examiner

*Primary Examiner*—David L. Lewis
(74) *Attorney, Agent, or Firm*—Nixon & Vanderhye P.C.

(57) ABSTRACT

A driver circuit for a display device includes a plurality of set-reset flip-flops and switch circuits, and is arranged so that a timing pulse for sampling outputted from the flip-flop is supplied to the switch circuit, so as to cause the switch circuit to receive a clock signal. The clock signal operates as a set signal of the next stage flip-flop and outputted as a control signal for carrying out pre-charging of a data signal line and a selected pixel connected to the data signal line, with a switch. Thus, in case of performing pre-charging of a signal supplying line with an internal pre-charging circuit by using a pre-charging power source having small driving ability, this arrangement can provide a driver circuit for a display device capable of preventing fluctuation of a signal supplied to a different signal supplying line, while keeping the circuit scale of the shift register small.

25 Claims, 18 Drawing Sheets

DRIVER CIRCUIT AND SHIFT REGISTER OF DISPLAY DEVICE AND DISPLAY DEVICE

FIELD OF THE INVENTION

The present invention relates to a driver circuit for carrying out pre-charging and supplying a signal with respect to signal supplying lines of a display device, and also relates to a shift register, and a display device.

BACKGROUND OF THE INVENTION

When a liquid crystal panel is driven by alternating driving in an active matrix type liquid crystal display device adopting a point-at-a-time method, a data signal line is pre-charged before a pixel is supplied with a video signal via the data signal line, so that each pixel is stably charged to a predetermined charge amount. In this arrangement, when the pre-charging is carried out with respect to all data signal lines at the same time, the power source for pre-charging is required to have high driving ability so as to deal with large writing amount for all data signal lines. Some pre-charging systems have been introduced as technologies to solve this problem by carrying out pre-charging with respect to a small group of the data signal lines.

For example, Japanese Laid-Open Patent Application Tokukaihei 07-295520/1995 published on Nov. 10, 1995 (corresponding to U.S. Pat. No. 5,686,936 issued on Nov. 11, 1997; hereinafter referred to as a patent document 1) discloses such an arrangement that, when a video signal is supplied to a data signal line, the sampling signal of the video signal outputted from a shift register of the data signal line driver turns on a switch of another data signal line, so as to carry out pre-charging of the data signal line from a pre-charging power source through the switch.

Further, Japanese Laid-Open Patent Application Tokukai 2000-89194/2000 published on Mar. 31, 2000 (corresponding to European patent publication No. EP0984423A2 issued on Mar. 8, 2000; hereinafter referred to as a patent document 2) discloses an arrangement of dividing the data signal lines into some blocks so that each block includes several number of data signal lines. In this arrangement, when a video signal is supplied to the n-th data signal line block from the data signal line driver, the sampling signal of the video signal carries out pre-charging of the n+1th data signal line block from a pre-charging power source.

Further, Japanese Laid-Open Patent Application Tokukai 2000-206491/2000 published on Jul. 28, 2000 (hereinafter referred to as a patent document 3) discloses an arrangement of using transfer pulse input of a transfer stage of the data signal line driver as a timing pulse for opening/closing an analog switch for carrying out pre-charging of the data signal line in the transfer stage, and also delaying the transfer pulse input to be later than the timing pulse for pre-charging, so as to use the input as a timing pulse for opening/closing an analog switch used for supplying actual data (video signal) to the data signal line. In this arrangement, the transfer pulse output of the transfer stage becomes a transfer pulse input of the next transfer stage, and this input is used as a timing pulse for carrying out pre-charging of the next stage transfer stage, and also used as a timing pulse of the output of actual data.

The data signal line drivers of foregoing arrangements use a switch having a capacitive control terminal of such as a MOSFET including a TFT (for example, a gate), in each data signal line. Also, the pre-charging voltage of the control terminal is controlled to be used for operating the switch between a conductive state and a non-conductive state in a point-at-a-time method. Upon its output, the control signal (for example, a gate signal) for operating the switch in a point-at-a-time method is normally shifted in a horizontal direction by a shift register made up of plural stages flip-flops. Further, another similar switch operated between a conductive state and a non-conductive state by a point-at-a-time method is additionally provided so as to carry out pre-charging of the data signal line.

Further, the foregoing arrangements disclosed in those publications can realize reduction in area of the pre-charging circuit. For example, the pre-charging circuit is provided inside of the data signal line driver for the purpose of providing a sufficient frame area of the liquid crystal display device.

Note that, Japanese Laid-Open Patent Application Tokukai 2001-135093 published on May 18, 2001 (has also been applied to US Patent Office with the application Ser. No. of 09/703,918; hereinafter referred to as a patent document 4), which is made prior to the present application by the same applicant as that of the present invention, discloses a configuration in which a switch circuit receives a clock signal outputted from the respective set-reset flip-flops of the shift register, and the received signal is used as a set signal of the next stage set-reset flip-flop. On the other hand, the present embodiment introduces a totally new idea such that a received clock signal is used as a control signal for carrying out pre-charging of the data signal line, and the pre-charging potential is supplied to a switch connected to the data signal line. Further, Japanese Laid-Open Patent Application Tokukai 2001-307495 published on Nov. 2, 2001 (has also been applied to US Patent Office with the application Ser. No. of 09/703,918; hereinafter referred to as a patent document 5), and Japanese Laid-Open Patent Application Tokukai 2000-339985 published on Dec. 8, 2000 (has also been applied to US Patent Office with the application Ser. No. of 09/578,440; hereinafter referred to as a patent document 6), which are made prior to the present application by the same applicant as that of the present invention, disclose a configuration of carrying out level shift of a received clock signal which is outputted from the respective set-reset flip-flop constituting the shift register, so as to use the clock signal as a set signal of the next stage set-reset flip-flop. On the other hand, the present embodiment introduces a totally new idea such that the control signal for carrying out pre-charging of the data signal line is generated by subjecting the clock signal to level shift, and the pre-charging potential is supplied to a switch connected to the data signal line.

However, the data signal line drivers disclosed in the patent document 1 and the patent document 2 use only one circuit for supplying a control signal for operating the switch between the conduction state and the non-conduction state so as to output a video signal to a data signal line, and also for supplying another control signal used for controlling a different switch between the conduction state and the non-conduction state so as to carry out pre-charging of another data signal line. In this arrangement, when pre-charging is carried out in alternating driving, the foregoing switching operation brings about a powerful charging current of an impulse state since the pre-charging in the alternating driving is carried out by powerfully changing the potential (almost inverting the polarity) of the data signal line and the pixel capacitance with respect to the potential in the previous sampling of the video signal. Since the control terminal of the switch is capacitive, a frequency component of this great charging current, which is relatively high, is transmitted to a control signal circuit of the switch via the capacitance of the control terminal, and therefore can fluctuate the potential of the control signal circuit, and may further fluctuate a video signal supplied to the data signal line via the control terminal of the switch for writing a video signal. Such fluctuation of the video signal causes such as a decrease of display uniformity, thereby degrading display quality.

On the other hand, the data signal line driver of the patent document 3 does not require the common use of the control signal circuits, and therefore the fluctuation of the video signal can be prevented; however, this arrangement requires a shift register for delaying the transfer pulse to be later than the timing pulse for pre-charging in addition to a shift register for transferring the transfer pulse, thus requiring a twice-scale shift register.

As has been explained, in case of carrying out pre-charging of a signal supplying line, such as a data signal line, with an internal pre-charging circuit by using a pre-charging power source having small driving ability, a conventional driver circuit of a display device such as a data signal line driver has failed to prevent fluctuation of a signal supplied to other signal supplying line while keeping the circuit scale of the shift register small. Note that, the patent documents 4 through 6 have no disclosures or suggestions regarding pre-charging.

SUMMARY OF THE INVENTION

The present invention is made in view of the foregoing conventional problems, and an object is to provide a driver circuit for a display device having an internal pre-charging circuit and carries out pre-charging of signal supplying lines with a pre-charging power source having small driving ability, and capable of preventing fluctuation of a signal supplied to other signal supplying lines while keeping the circuit scale of the shift register small. Further, the present invention also provides a shift register used for the driver circuit, and a display device including the driver circuit.

In order to solve the foregoing problems, a driver circuit according to the present invention includes: a writing circuit, which is a driver circuit for a display device including a plurality of signal supplying lines, the writing circuit having a plurality of first switches for each of the signal supplying lines so as to carry out writing of a write signal into the signal supplying lines by bringing the first switches into conduction, the first switches being controlled between a conductive state and a non-conductive state according to a voltage of a first control terminal which is capacitive; a shift register having a plural stages of flip-flops for outputting a timing pulse used for the writing toward the first control terminal so that the timing pulse is sequentially transferred through the flip-flops so as to carry out the writing at predetermined cycles; and a pre-charging circuit having a plurality of second switches for each of the signal supplying lines so as to carry out pre-charging of the signal supplying lines by bringing the second switches into conduction, the second switches being controlled between a conductive state and a non-conductive state according to a voltage of a second control terminal which is capacitive, while the writing is carried out with respect to a part of the signal supplying lines, the pre-charging circuit carrying out the pre-charging of at least one of the remaining signal supplying lines, and the shift register including control signal supplying circuits which output a pre-charging control signal for controlling the second switches to the second control terminal via a second signal line which is separated from a first signal line which transmits the timing pulse to the first control terminal.

This arrangement allows signal writing with respect to a signal supplying line while carrying out pre-charging of a different signal supplying line. Further, here, the signal writing and the pre-charging are not carried out with the same one of the control circuit of the first switch and the control circuit of the second switch. On this account, it is possible to prevent such a phenomenon that a large current flowing into the data signal line with the pre-charging causes fluctuation of the potential of the write signal of the data signal line subjected to writing at the time, via the capacitive control terminals of the first switch and the second switch. Further, since the control signal supplying circuit, which outputs a pre-charging control signal for controlling conduction of the second switch to the second control terminal, can be composed in a simpler structure than that of the flip-flop, the circuit scale of the shift register will be much smaller than the conventional configuration with the twice-scale shift register.

Accordingly, for performing pre-charging of signal supplying lines with an internal pre-charging circuit by using a pre-charging power source having small driving ability, the foregoing configuration can provide a driver circuit of a display device capable of preventing fluctuation of a signal supplied to a different signal supplying line, while keeping the circuit scale of the shift register small.

Note that, the pre-charging circuit can be any types of circuit as long as it enables signal writing with respect to a signal supplying line while carrying out pre-charging of a different signal supplying line, and therefore, the number of signal supplying lines at the writing or at the pre-charging is not particularly limited.

Further, the foregoing "two separated signal lines" designates a state where two signal lines are not electrically connected to each other. This can be a state where one of the two signal lines is connected to the source or the drain of the transistor while the other is connected to the transistor, or a state where the two signal lines are insulated from each other.

Further, the control signal supplying circuit can be (1) the one transfers an externally supplied clock signal (from outside of the driver circuit, for example) to the second control terminal as a pre-charging control signal, (2) the one transfers an externally supplied clock signal (from outside of the driver circuit, for example) to the second control terminal as a pre-charging control signal after processing the clock signal (level shift, for example), or (3) the one generates a pre-charging control signal and outputs the control signal to the second control terminal. Among these, the arrangements (1) and (2) are advantageous in terms of reduction of the circuit scale of the control signal supplying circuit.

Further, the pre-charging control signal is preferably synchronized with the clock signal. This signal synchronized with the clock signal can be, for example, the clock signal itself, the clock signal processed by level shift, or an inversion signal of the clock signal.

Further, in order to solve the foregoing problems, a shift register according to the present invention includes: a plural stages of flip-flops for outputting a timing pulse used for writing of a write signal into a plurality of signal supplying lines provided in a display device so that the timing pulse is sequentially transferred through the flip-flops so as to carry out the writing at predetermined cycles; and a plurality of control signal supplying circuits provided according to a number of the signal supplying lines pre-charged in the writing effective period, upon input of the timing pulse from the flip-flop in a writing effective period, which is a period for carrying out the writing during the predetermined cycle, the control signal supplying circuits bringing the second switches into conduction by receiving a clock signal supplied from a signal source different from a signal source for supplying the timing pulse, and outputting a pre-charging control signal synchronized with the clock signal for carrying out pre-charging of a predetermined one of the signal supplying lines which is not subjected to the writing.

Therefore, in case of performing pre-charging of a signal supplying line with an internal pre-charging circuit by using a pre-charging power source having small driving ability, the foregoing arrangement can provide a shift register having a small circuit scale and is suitably used for a driver circuit for a display device capable of preventing fluctuation of a signal supplied to a different signal supplying line.

Further, in order to solve the foregoing problems, a display device according to the present invention includes: a plurality of pixels; a plurality of data signal lines as signal supplying lines and a plurality of scanning signal lines as signal supplying lines; a data signal line driver for writing a video signal as a write signal with respect to the data signal lines and the pixels; and a scanning signal line driver for writing a scanning signal as a write signal to the scanning signal lines so as to select a pixel to which the video signal is written, characterized in that the data signal line driver operates to be one of the foregoing driver circuits for a display device.

Therefore, when a data signal line driver performs pre-charging of a signal supplying line with an internal pre-charging circuit by using a pre-charging power source having small driving ability, the foregoing configuration can provide a driver circuit of a display device capable of preventing fluctuation of a signal supplied to a different signal supplying line, while keeping the circuit scale of the shift register small. As a result, display uniformity is ensured in the display device, thus providing a display device having high display quality.

Additional objects, features, and strengths of the present invention will be made clear by the description below. Further, the advantages of the present invention will be evident from the following explanation in reference to the drawings.

DESCRIPTION OF THE EMBODIMENTS

First Embodiment

Figure 1:
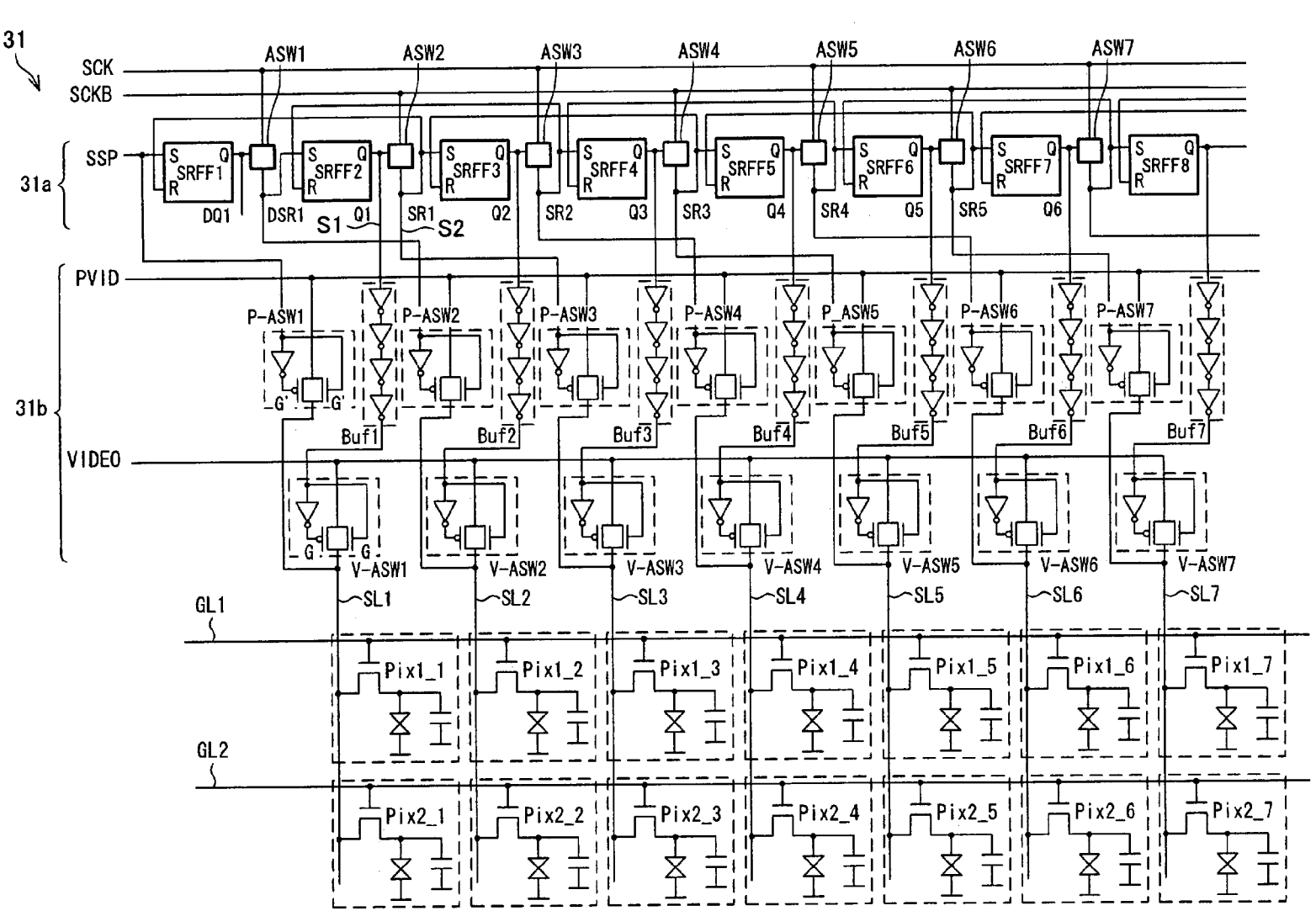
FIG. 1 is a circuit block diagram showing an arrangement of a data signal line driver according to First Embodiment of the present invention.
Figure 2:
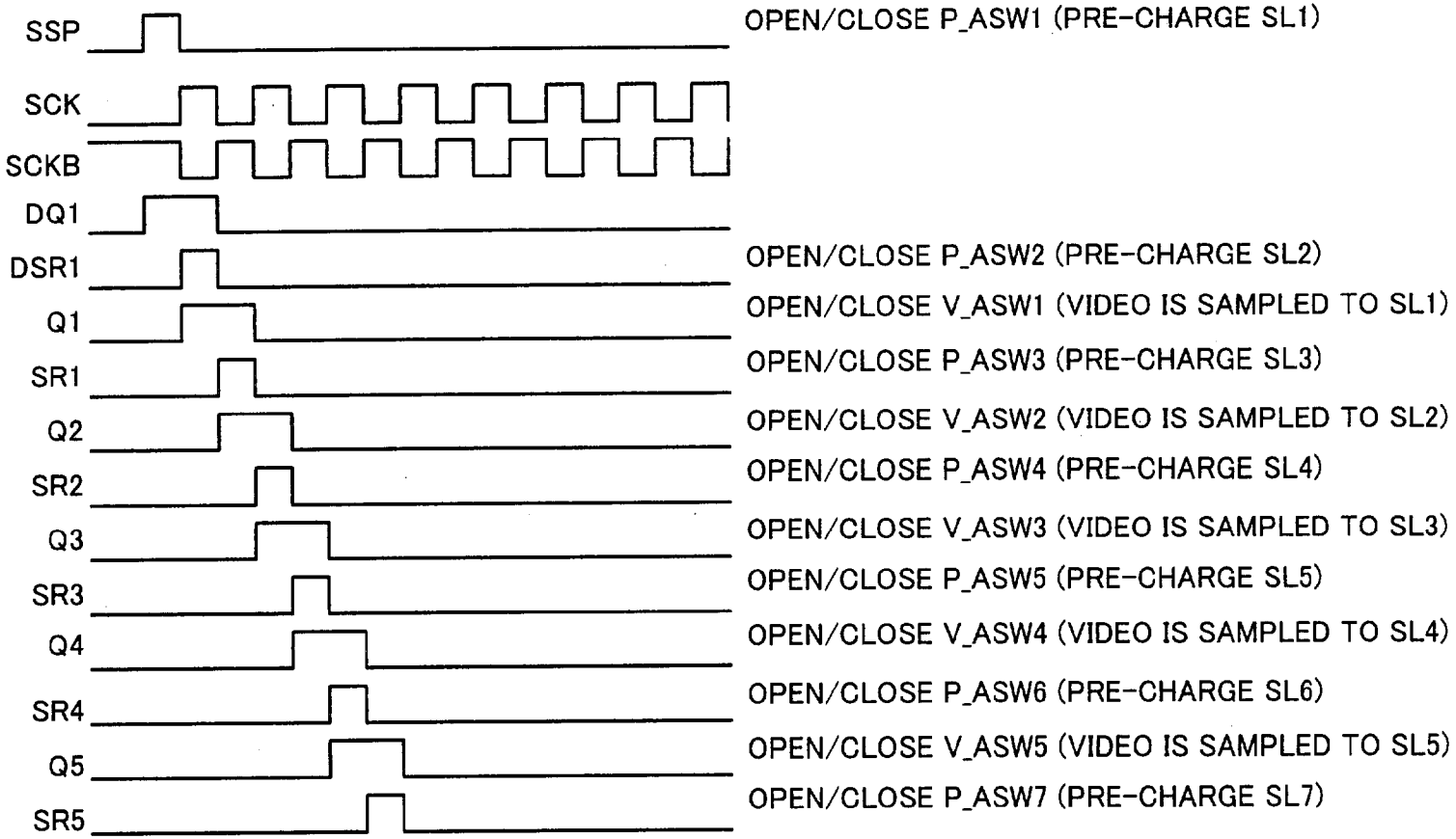
FIG. 2 is a timing chart of a signal regarding the operation of the data signal line driver of FIG. 1.

The following will explain one embodiment of the present invention with reference to FIGS. 1 and 2.

The present embodiment uses a data signal line driver included in a liquid crystal display device, as a driver circuit of a display device of the present invention. FIG. 1 shows a configuration of a data signal line driver 31 as an example of such a data signal line driver.

The data signal line driver 31 includes a shift register 31*a* and a sampling section 31*b*.

The shift register 31*a* includes plural stages of set-reset type flip-flops SRFF1, SRFF2, . . . , and plural switch circuits (control signal supplying circuit) ASW1, ASW2, . . . The switch circuit ASWk (k=1, 2, . . . ) uses a Q output of the flip-flop SRFFk as a control signal for switching itself between a conductive state and a non-conductive state. Upon its conductive state, an odd-numbered switch circuit ASWk receives a clock signal (pre-charging control signal (a signal for carrying out pre-charging)) SCK supplied from an external source, and also outputs the clock signal. This clock signal is different from a timing pulse described later. Further, upon its conductive state, an even-numbered switch circuit ASWk receives a clock signal (pre-charging control signal) SCKB supplied from an external source, and also outputs the clock signal. This clock signal is also different from the timing pulse. The clock signal SCKB is an inversion signal of the clock signal SCK.

The switch circuits ASW1, ASW2, . . . output the clock signal SCK/SCKB (output signals SR1, SR", . . . ; described later) to the switch P-ASWn (described later) via a signal line (second signal line) S2, which is separated from a signal line (first signal line) S1 for transmitting the Q output of the flip-flop SRFFk to the switch V-ASWn (described later). Further, the switch circuits ASW1, ASW2, . . . receive the clock signal SCK/SCKB from an external source via a signal line, which is separated from a signal line (first signal line) S1 for transmitting the Q output of the flip-flop SRFFk to the switch V-ASWn (described later).

The switch circuit ASW1 outputs an output signal DSR1, and the switch circuit ASW2, ASW3 . . . respectively output output signals SR1, SR2 . . . An output signal of each of the switch circuit ASWk is used as a set signal of the flip-flop SRFF (k+1), and also used as an input signal to a switch P-ASW (k+1) included in a pre-charging circuit of the sampling section 31*b* (described later).

Figure 19:
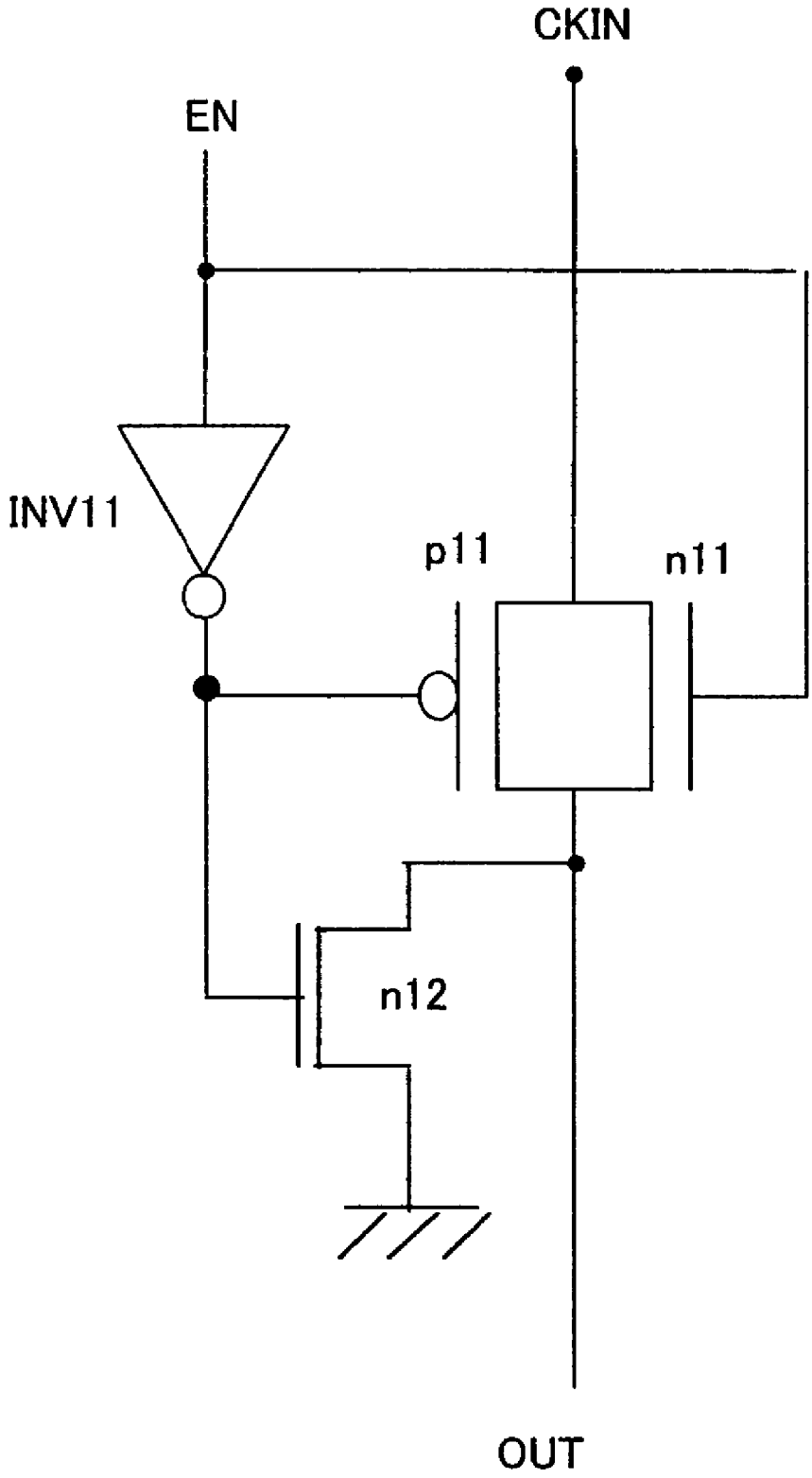
FIG. 19 is a circuit diagram showing an arrangement of an example of a switch circuit.

The following will explain an example of a switch circuit which can be used as switch circuits ASW1, ASW2, . . . with reference to FIG. 19. FIG. 19 is a circuit diagram showing an arrangement of an example of the switch circuit.

The switch circuit is made up of an inverter circuit INV11, a CMOS switch including a pch transistor p11 and an nch transistor n11, and an nch transistor n12. Upon input of a control signal EN which is externally supplied, and when this control signal EN is HIGH, the nch transistor n12 is closed, and the pch transistor p11 and the nch transistor n11 of the CMOS switch are opened, and a signal CKIN externally supplied is outputted without modification as an output signal OUT. Further, when the control signal EN is LOW, the pch transistor p11 and the nch transistor n11 of the CMOS switch are closed, and the nch transistor n12 is opened, and the output signal OUT is fixed to LOW. The control signal EN corresponds to the Q output of the flip-flop SRFFk of FIG. 1. Further, the input signal CKIN corresponds to the clock signal SCK or the clock signal SCKB of FIG. 1. Further, the output signal OUT corresponds to the output signals DSR1, SR1, SR2, . . . of FIG. 1.

The flip-flop SRFFk outputs an output signal DQ 1 as the Q output when k=1, and outputs output signals Q1, Q2, . . . when K=2, 3. . . The output signal of the switch circuit ASW (k+2) is used as a reset signal of the flip-flop SRFFk. As to a set signal of the first-stage flip-flop SRFF1, a start pulse SSP is externally supplied. This start pulse SSP also operates as an input signal of the switch P-ASW. The output signal DQ1 of the flip-flop SRFF1 is inputted to the switch circuit ASW1, and the output signals Q1, Q2, . . . of the flip-flop SRFF2, SRFF3, . . . are respectively inputted to switches V-ASW1, V-ASW2, . . . of the sampling section 31*b* (described later) via buffers Buf1, Buf2, . . . of the sampling section 31*b*. The output signals Q1, Q2, . . . become timing pulses for sampling of a video signal VIDEO (described later).

Next, the sampling section (writing circuit, pre-charging circuit) 31*b* includes the buffers Buf1, Buf2, . . . the switches V-ASW1, V-ASW2, . . . and the pre-charging circuit. The pre-charging circuit includes the switches P-ASW1, P-ASW2, . . . The writing circuit is made up of buffers Buf1, Buf2, . . . , and the switches V-ASW1, V-ASW2, . . .

The buffer Bufn (n=1, 2, . . . ) is connected to a set of four inverters in a state of cascade connection, and supplied with, as thus described, the output signal Qn of the shift register 31*a*. The switch (first switch) V-ASWn is supplied with the output signal of the buffer Bufn as an input signal. The switch V-ASWn is made up of an analog switch including an N-channel MOS transistor (TFT) where the input signal is directly inputted via a gate (first control terminal) G and a P-channel MOS transistor (TFT) where an inversion signal of the input signal is inputted via a gate G, and an inverter for inverting the input signal supplied to the gate of the P-channel MOS transistor. Each gate G of the respective MOS transistors is a capacitive control terminal, and the switch V-ASWn is switched between a conductive state and a non-conductive state according to the charging voltage of the gate. Further, one end of a channel path of the analog switch of each of the switches V-ASWn is supplied with a common analog video signal (write signal) VIDEO, which is externally supplied.

As it is described in the foregoing explanation, the switch (second switch) P-ASWn is supplied with the set signal of the flip-flop SRFFk (k=n) as an input signal. The switch P-ASWn is made up of an analog switch including an N-channel MOS transistor where the input signal is directly inputted via a gate (second control terminal) G' and a P-channel MOS transistor where an inversion signal of the input signal is inputted via a gate G', and an inverter for inverting the input signal supplied to the gate of the P-channel MOS transistor. Each gate G' of the respective MOS transistors is a capacitive control terminal, and the switch P-ASWn is switched between a conductive state and a non-conductive state according to the charging voltage of the gate. Further, one end of a channel path of the analog switch of each of the switches P-ASWn is supplied with a common pre-charging potential PVID, which is externally supplied.

Further, the other end of the channel path of the analog switch of each of the switches V-ASWn and the other end of the channel path of the analog switch of each of the switches P-ASWn are connected to a data signal line (signal supplying line) SLn (n=1, 2, . . . ) provided on a liquid crystal display panel. The liquid crystal display panel further includes scanning signal lines GL1, GL2, . . . , each of which is provided to be orthogonal to the data signal line SLn. Further, a pixel Pixm-n (m=1, 2, . . . , n=1, 2, . . . ) is provided in the intersection point of the data signal line SLn and the scanning signal line GLm (m=1, 2, . . . ) in a matrix manner. As with a normal active matrix type liquid crystal display device, each pixel has N-channel MOS transistor (TFT), a liquid crystal capacitance, and an auxiliary capacitance. The scanning signal line GLm is selected at predetermined cycles, and brings the MOS transistor of the pixel connected to the scanning signal line GLm into conduction during the selected period.

The following will explain an operation of the data signal line driver having the foregoing configuration with reference to the timing chart shown in FIG. 2.

The following will explain 1 period which is a time period during a scanning line GLm is selected. In this period, when carrying out pre-charging to the data signal line SL, both the data signal line SL and a pixel selected and connected to the data signal line SL are pre-charged, as the scanning signal line GLm is selected. Upon input of the start pulse SSP, an output signal DQ1 is outputted from the flip-flop SRFF1, and the start pulse SSR is supplied to the switch P-ASW1. As a result, the analog switch of the switch P-ASW1 becomes conductive (the conduction state of the switch will hereinafter be described as that the switch becomes conductive/non-conductive), and the pre-charging potential PVID is supplied to the data signal line SL1. Through this operation, the data signal line SL1 and the capacitance of the selected pixel are both pre-charged. Here, since the switch V-ASW1 is non-conductive, the pre-charging potential PVID will not disturb the video signal VIDEO on the data signal line SL1.

Further, the switch circuit ASW1 becomes conductive by the output signal DQ1, and receives the clock signal SCK and outputs an output signal DSR1. The output signal DSR1 is used as a set signal of the flip-flop SRFF2, and the flip-flop SRFF2 outputs an output signal Q1. Also, the switch ASW2 becomes conductive by the output signal Q1, and receives the clock signal SCKB and outputs an output signal SR1. Further, the output signal Q1 operates as a timing pulse and brings the switch V-ASW1 into conduction via the buffer Buf 1. As a result, the data signal line SL1 is supplied with the video signal VIDEO, and the data signal line SL1 and the pixel capacitance are charged to a predetermined voltage. In more specific expression, the video signal VIDEO is sampled, and a sampling effective period (writing effective period) is started. In this sampling effective period, the respective data signal lines in the predetermined period are sequentially sampled.

Since the start pulse SSR becomes low by this stage, the switch P-ASW1 is non-conductive, and therefore the pre-charging potential PVID will not disturb the video signal VIDEO on the data signal line SL1. Further, the output signal DSR1 brings the switch P-ASW2 into conduction, and therefore, the video signal VIDEO is outputted to the data signal line SL2, and simultaneously, the data signal line SL2 and the pixel capacitance are pre-charged. Meanwhile, since the output signal SR1 operates as a reset signal of the flip-flop SRFF1, the output signal DQ1 of the flip-flop SRFF1 becomes low. As a result, the switch ASW1 becomes non-conductive.

In this manner, the sampling is carried out in a point-at-a-time method by sequentially repeating such an operation that the video signal VIDEO is supplied to the data signal line SLn after the pre-charging of the data signal line SLn, and while the data signal line SLn is supplied with the video signal VIDEO, the data signal line SL (n+1) is pre-charged. This operation corresponds to the operation of the timing pulse, which is sequentially transferred in the shift register toward a later stage flip-flop SRFF, by the flip-flop SRFFk and the switch ASWk. As shown in FIG. 2, two adjacent sampling periods overlap each other by a half period of the clock signals SCK and SCKB. In this case, the sampling potential is determined by the pixel capacitance and the pre-charging potential of the data signal line at a falling phase of the timing pulse in the respective sampling periods.

The above-mentioned sampling effective period is a time period until the sampling of the last-stage data signal line SL is completed, and the pre-charging of the data signal line not sampled in this period is performed as follows: the clock signals SCK and SCKB supplied from a signal source, which is different to the signal source for supplying the timing pulse, are received and outputted by the switch circuit ASWk, and the switch P-ASWn (n=k+1) becomes conductive with the charging of the control terminal (gate G'). In order to constantly carry out such a pre-charging in the sampling effective period, the total number of the switch circuits ASWk is equal to the number of the data signal lines SL pre-charged in the sampling effective period. This switch circuit may be replaced to other means for carrying out pre-charging during the period where the sampling is ineffective (for example, pre-charging of the data signal line SL1).

With the foregoing arrangement, it is possible to carry out sampling of the video signal VIDEO with respect to the data signal line SL, while carrying out pre-charging of other data signal line SL. Further, here, since the timing pulse for the sampling is supplied from a different system to the system for supplying the signal for pre-charging, the control signal circuit of the switch V-ASW and the control signal circuit of the switch P-ASW will not be provided as one circuit. On this account, it is possible to prevent such a phenomenon that a large current flowing into the data signal line SL upon the pre-charging causes fluctuation of the potential of the video signal VIDEO of the data signal line SL subjected to writing at the time, via the capacitive control terminal (gate G') of the switch P-ASW. Further, since the switch circuit ASWk for receiving and outputting the clock signals SCK and SCKB can be composed in a simpler structure than that of the flip-flop, the circuit scale of the shift register 31*a* will be much smaller than the conventional configuration having the twice-scale shift register.

Accordingly, for performing pre-charging of a signal supplying line with an internal pre-charging circuit by using a pre-charging power source having small driving ability, the foregoing configuration can provide a driver circuit of a display device capable of preventing fluctuation of a signal supplied to a different signal supplying line, while keeping the circuit scale of the shift register small.

Note that, in contrast to the patent document 4, the present embodiment introduces a totally new idea such that a received clock signal is used as a control signal for carrying out pre-charging of the data signal line, and the pre-charging potential is supplied to a switch connected to the data signal line.

Second Embodiment

Figure 3:
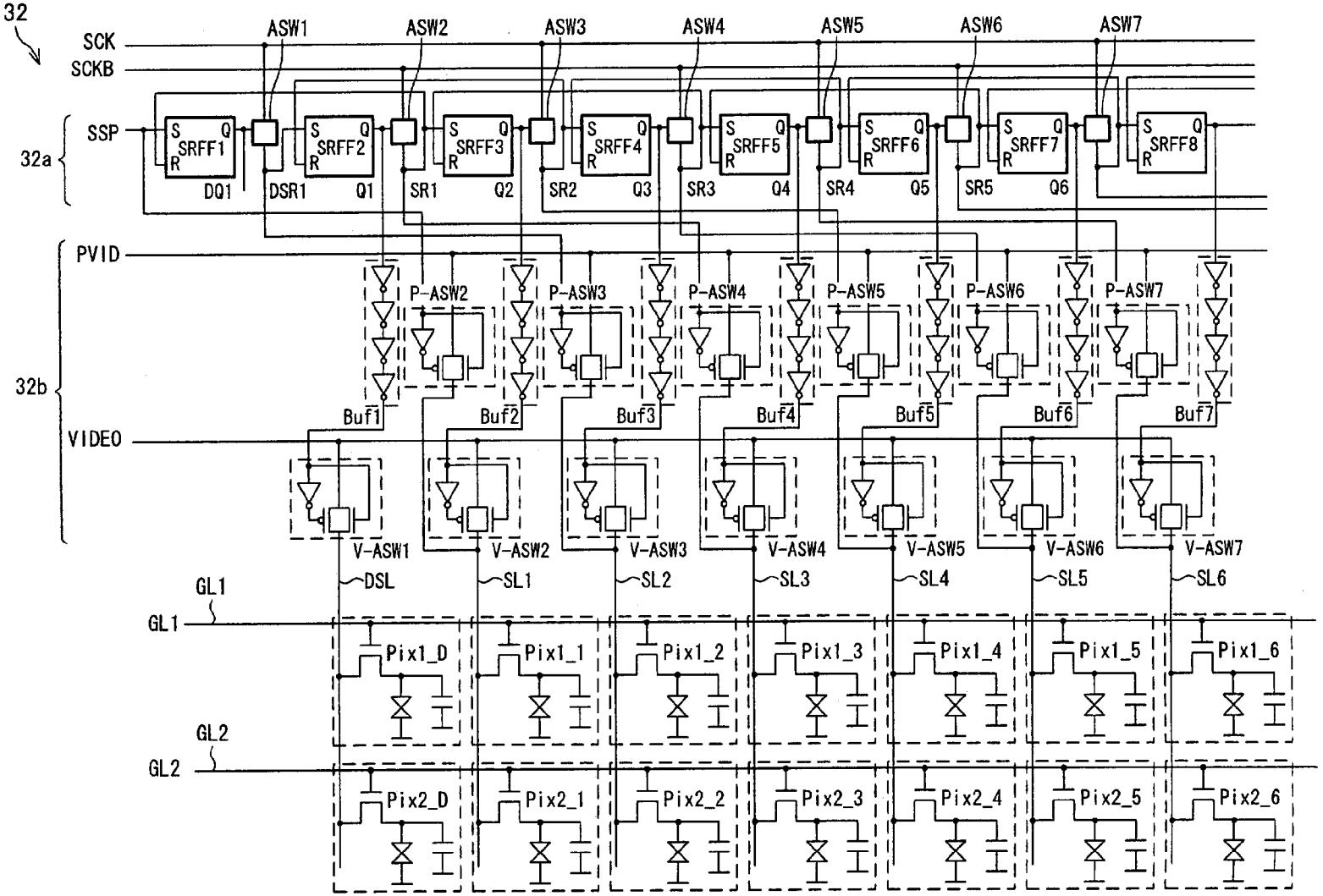
FIG. 3 is a circuit block diagram showing an arrangement of a data signal line driver according to Second Embodiment of the present invention.
Figure 4:
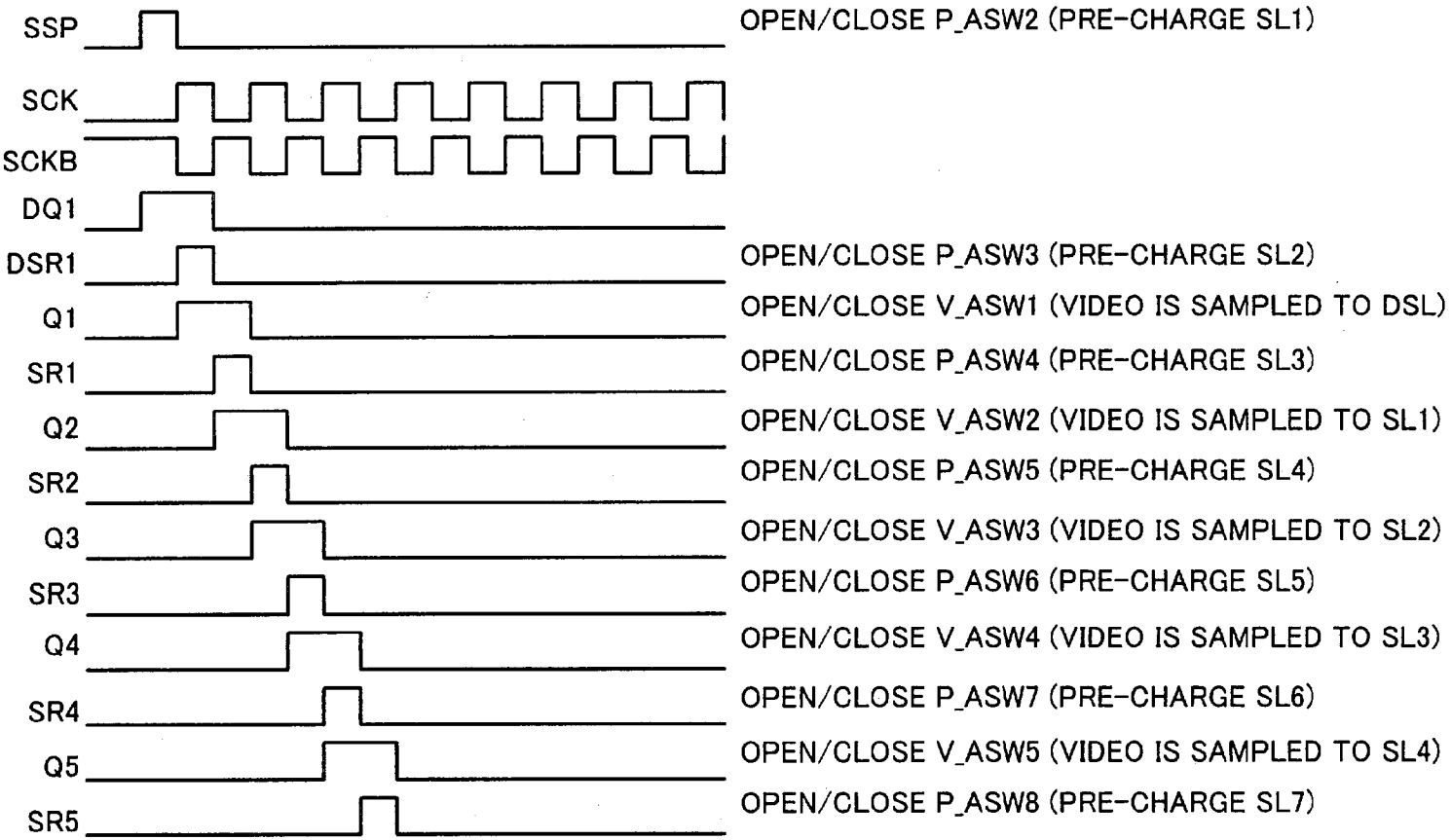
FIG. 4 is a timing chart of a signal regarding the operation of the data signal line driver of FIG. 3.

The following will explain another embodiment of the present invention with reference to FIGS. 3 and 4. For ease of explanation, materials having the equivalent functions as those shown in the drawings pertaining to First Embodiment above will be given the same reference symbols, and explanation thereof will be omitted here.

The present embodiment uses a data signal line driver included in a liquid crystal display device, as a driver circuit of a display device of the present invention. FIG. 3 shows a configuration of a data signal line driver 32 as an example of such a data signal line driver.

The data signal line driver 32 includes a shift register 32*a* and a sampling section (writing circuit, pre-charging circuit) 32*b*.

The shift register 32*a* has the same internal arrangement as that of the shift register 31*a*; however, in this shift register 32*a*, the signal for pre-charging is outputted to a different switch. The start pulse SSP used as a set signal of the flip-flop SRFF1 is inputted to the switch P-ASW2 as a signal for pre-charging. Further, the output signal DSR1 is supplied to the switch P-ASW3. Further, the output signal SR (k−1) (k=2, 3, . . . ) are supplied to the switch P-ASWn (n=k+2).

In contrast to the sampling section 31*b* shown in FIG. 1, the sampling section 32*b* does not include the switch P-ASW1. Further, the data signal line SL1 of FIG. 1 is replaced to a dummy data signal line DSL, and the data signal lines SL2, SL3 . . . of FIG. 1 are replaced to the data signal lines SL1, SL2 . . . in FIG. 3. Further, the pixel connected to the data signal line DSL is replaced to a dummy pixel m-D (m=1, 2, . . . ), and therefore, the pixels connected to the data signal lines SL1, SL2, . . . are shifted by the dummy pixel in a horizontal direction. Namely, the data signal line driver 32 of the present embodiment is suitably used as a driver circuit of a display device including a dummy data signal line and a dummy pixel.

FIG. 4 is a timing chart showing an operation of the data signal line driver 32 having the foregoing arrangement. Since the signal transmission principle is the same as that of the case of FIG. 1, a minute explanation is omitted. The characteristic of this data line signal driver 32 is that the end of the pre-charging and the beginning of the sampling are different by a half period of the clock signals SCK and SCKB in the same data signal line SL. Specifically, the sampling with respect to the data signal line SL1 is carried out when a half period of the clock signal SCK and SCKB is elapsed after the pre-charging of the data signal line SL1 with the conduction of the switch P-ASW2 by the start pulse SSR.

On this account, in addition to the effect described in First Embodiment, it is possible to unfailingly prevent the pre-charging potential PVID and the video signal VIDEO from disturbing each other, thus improving display quality. Note that, since the dummy pixel is generally provided under a light blocking body called black matrix, the display of the dummy pixel does not appear on the screen. Therefore, pre-charging of the dummy pixel and the dummy data signal line are not necessary.

Third Embodiment

Figure 5:
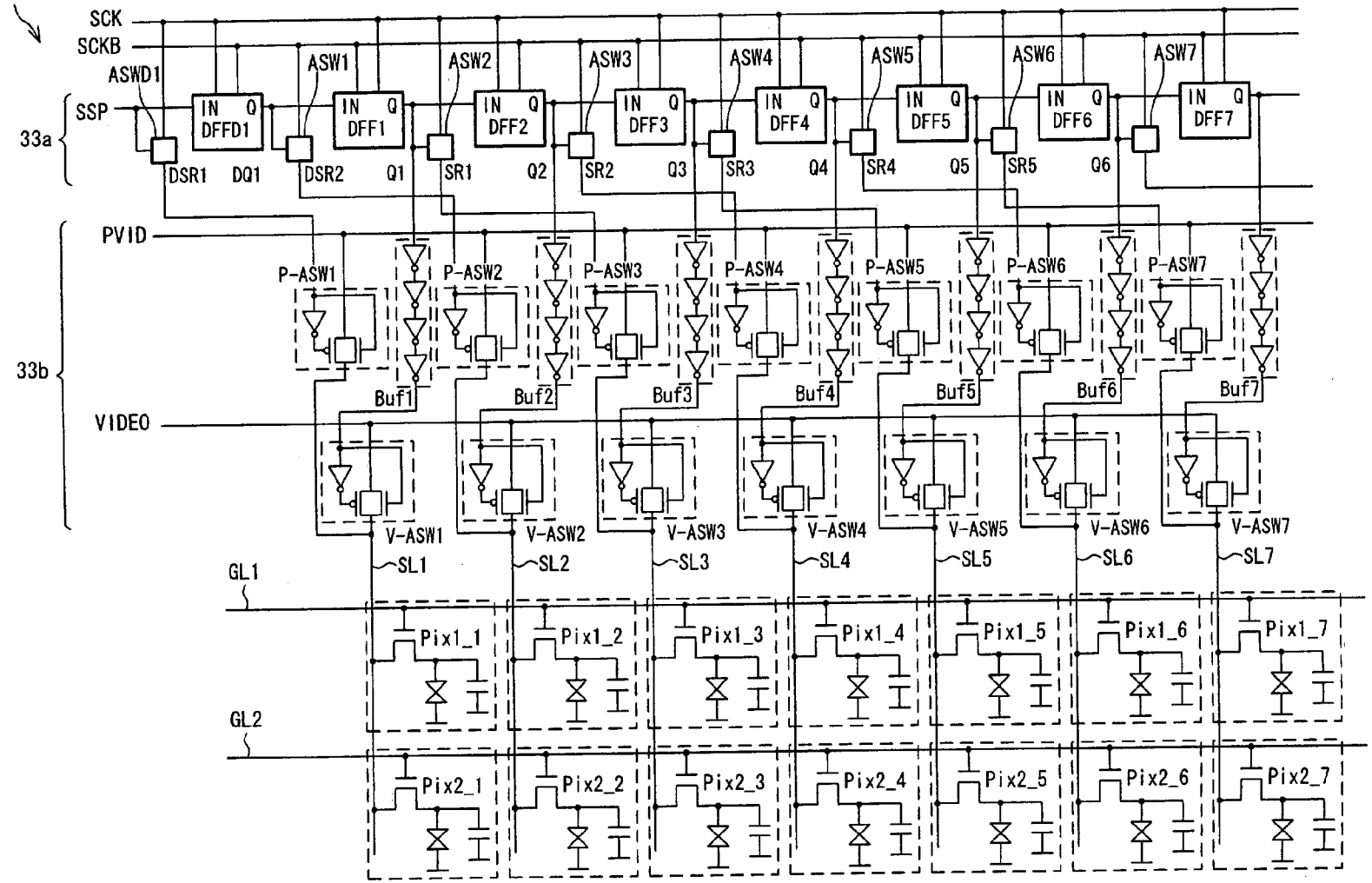
FIG. 5 is a circuit block diagram showing an arrangement of a data signal line driver according to Third Embodiment of the present invention.
Figure 6:
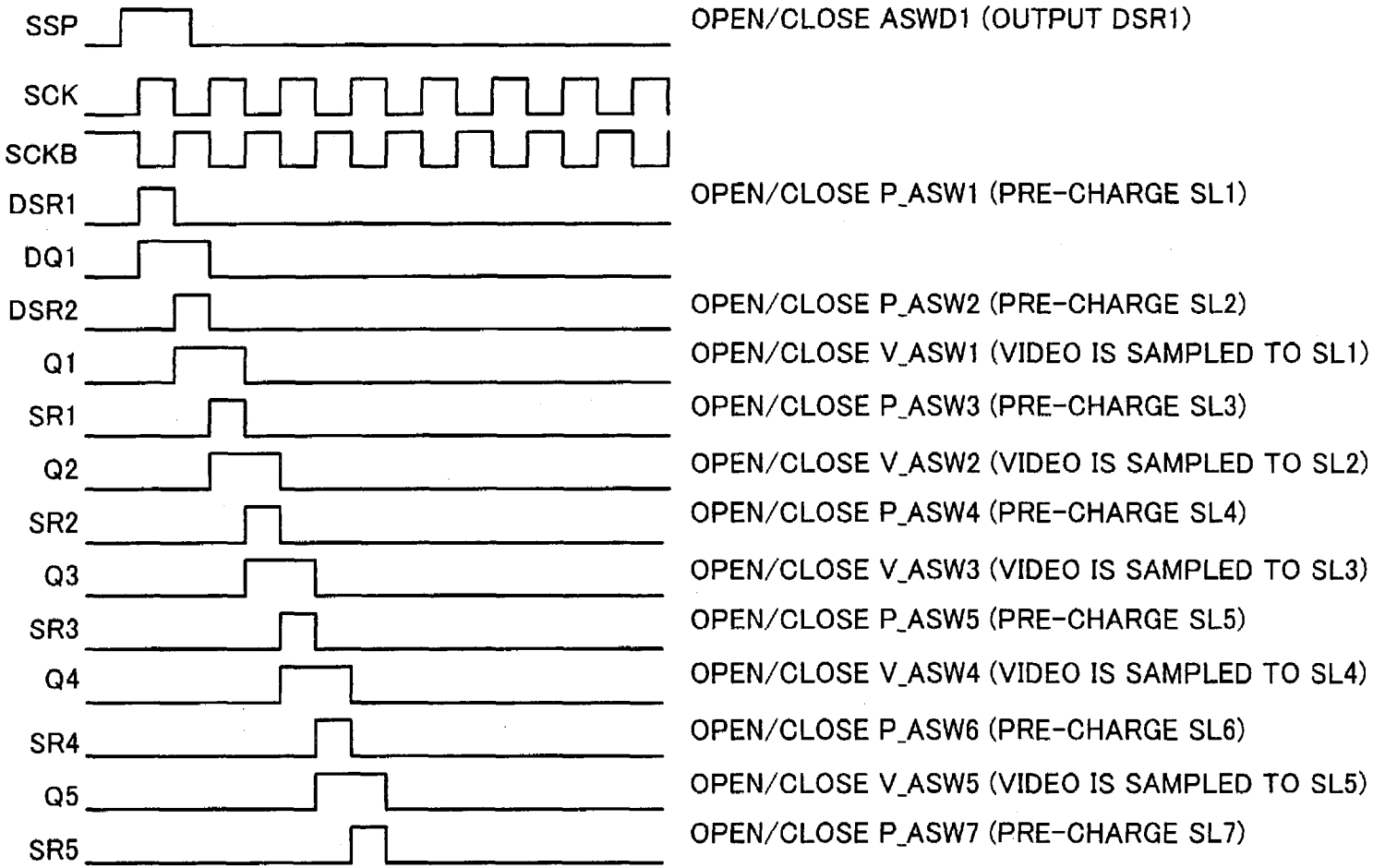
FIG. 6 is a timing chart of a signal regarding the operation of the data signal line driver of FIG. 5.

The following will explain a still another embodiment of the present invention with reference to FIGS. 5 and 6. For ease of explanation, materials having the equivalent functions as those shown in the drawings pertaining to First and Second Embodiments above will be given the same reference symbols, and explanation thereof will be omitted here.

The present embodiment uses a data signal line driver included in a liquid crystal display device, as a driver circuit of a display device of the present invention. FIG. 5 shows a configuration of a data signal line driver 33 as an example of such a data signal line driver.

The data signal line driver 33 includes a shift register 33*a* and a sampling section (writing circuit, pre-charging circuit) 33*b*.

The shift register 33*a* includes plural stages of D flip-flop: flip-flops DFFD1, DFF1, DFF2, . . . , and plural switch circuits ASWD1, ASW1, ASW2, . . . An input signal IN of the first stage flip flop DFFD1 is the start pulse SSP, and those flip-flops are connected to each other in a state of cascade connection so that Q-output of each of the flip-flops is used as the input signal IN of the next stage flip-flop. Further, the switch circuits all have the same arrangements, and the switch circuit ASWD1 uses the start pulse SSP, the switch circuit ASW1 uses the Q output of the flip-flop DFFD1, the switch circuits ASW2, ASW3, . . . respectively uses the Q output of the flip-flops DFF1, DFF2, . . . , as a control signal for switching themselves between a conductive state and a non-conductive state.

Upon the conductive state, the switch circuit ASWD1 and an even-numbered switch circuit ASWk receive a clock signal SCK for operating the flip-flop, and also outputs the clock signal. This clock signal SCK is supplied from an external source, which is different from the source for supplying a timing pulse described later. Further, upon the conductive state, an odd-numbered switch circuit ASWk receives a clock signal SCKB for operating the flip-flop, and also outputs the clock signal. This clock signal is also supplied from an external source and different from the timing pulse. The clock signals SCK and SCKB are used for operation of a clocked inverter inside of the flip-flop.

The switch circuit ASWD1 outputs an output signal DSR1, and the switch circuit ASW2, ASW3 . . . respectively output output signals SR1, SR2 . . . . An output signal of each of the switch circuit ASDW1, ASW1, ASW2, . . . is used as an input signal to a switch P-ASW1, P-ASW2, P-ASW3, . . . included in a pre-charging circuit of the sampling section 33*b*.

The flip-flop DFFD1 outputs an output signal DQ1, and the flip-flop DFFn (n=1, 2, . . . ) outputs an output signal Qn as the Q output. The output signal Qn of the flip-flop DFFDn is inputted to the switch V-ASWn of the sampling section 33*b* via a buffer Bufn of the sampling section 33*b*. The output signal Qn becomes a timing pulse used for sampling of a video signal VIDEO (described later).

Further, the sampling section 33*b* (writing circuit) has the same internal arrangement as that of the sampling section 31*b* of FIG. 1, and has the foregoing connection relation with the shift register 33*a*. Further, a data signal line SLn (n=1, 2, . . . ), a scanning signal line SLm (m=1, 2, . . . ), and a pixel Pixm-n (m=1, 2, . . . , n=1, 2, . . . ) are the same as those of FIG. 1.

The following will explain an operation of the data signal line driver 33 having the foregoing configuration with reference to the timing chart shown in FIG. 6.

The following will explain 1 period which is a time period during a scanning line GLm is selected. In this period, when carrying out pre-charging to the data signal line SL, both the data signal line SL and a pixel selected and connected to the data signal line SL are pre-charged, as the scanning signal line GLm is selected. Upon input of the start pulse SSP, the switch circuit ASWD1 becomes conductive, and receives the clock signal SCK and outputs the output signal DSR1. This brings the switch P-ASW1 into conduction, and the pre-charging potential PVID is applied to the data signal line SL1, and pre-charging is carried out with respect to both the data signal line SL1 and the pixel capacitance.

Further, the flip-flop DFFD1 starts outputting the start pulse SSP as the output signal DQ1 at a rising phase of the clock signal SCK, and holds the output of the output signal DQ1 until the next rising of the clock signal SCK. During the input of the output signal DQ1, the flip-flop DFF1 starts outputting the output signal DQ1 as the output signal Q1 at a rising phase of the clock signal SCKB, and holds the output of the output signal DQ1 until the next rising of the clock signal SCKB. While the output signal Q1 is kept to "High", the output signal Q1 brings the switch V-ASW1 into conduction via the buffer Buf1 as the timing pulse for sampling. As a result, the video signal VIDEO is sampled to the data signal line SL1 and the pixel capacitance, and a sampling effective period (writing effective period) is started. Since the output signal DSR1 becomes low by this stage, the switch P-ASW1 is non-conductive, and therefore the pre-charging potential PVID will not disturb the video signal VIDEO on the data signal line SL1.

Further, the switch circuit ASW1 becomes conductive by the output signal DQ1, and receives the clock signal SCKB and outputs an output signal DSR2. Thus, the data signal line SL2 is pre-charged during the sampling with respect to the data signal line SL1.

In this manner, the sampling is carried out in a point-at-a-time method by sequentially repeating such an operation that the video signal VIDEO is supplied to the data signal line SLn after the pre-charging of the data signal line SLn, and while the data signal line is supplied with the video signal VIDEO, the data signal line SL (n+1) is pre-charged. This operation corresponds to the operation of the timing pulse, which is sequentially transferred in the shift register toward a later stage flip-flop by the flip-flop DFFD1, DFF1, DFF2, . . . As shown in FIG. 6, two adjacent sampling periods overlap each other by a half period of the clock signals SCK and SCKB. In this arrangement, the sampling potential is determined by the pixel capacitance and the pre-charging potential of the data signal line at a falling phase of the timing pulse in the respective sampling periods.

The above-mentioned sampling effective period is a time period until the sampling of the last-stage data signal line driver SL is finished, and the pre-charging of the data signal line not sampled in this period is performed as follows: the clock signals SCK and SCKB supplied from a source different to that for supplying the timing pulse are received and outputted by the switch circuit ASWD1, ASW1, ASW2, . . . , and the switch P-ASWn becomes conductive with the charging of the control terminal (gate G'). In order to constantly carry out such a pre-charging in the sampling effective period, the total number of the switch circuits ASWk is equal to the number of the data signal lines SL pre-charged in the sampling effective period. This switch circuit may be replaced to other means for carrying out pre-charging other than the sampling effective period (for example, pre-charging of the data signal line SL1).

With the foregoing method, it is possible to carry out sampling of the video signal VIDEO with respect to the data signal line SL, while carrying out pre-charging of other data signal line SL. Further, here, since the timing pulse for the sampling is supplied from a different system to the system from which the signal for pre-charging is supplied, the control signal circuit of the switch V-ASW and the control signal circuit of the switch P-ASW will not be provided as one circuit. On this account, it is possible to prevent such a phenomenon that a large current flowing into the data signal line SL with the pre-charging causes fluctuation of the potential of the video signal VIDEO of the data signal line SL subjected to writing at the time, via the capacitive control terminal (gate G') of the switch P-ASW. Further, since the respective switch circuits ASWD1 and ASWk for receiving and outputting the clock signals SCK and SCKB can be composed in a simpler structure than that of the flip-flop, the circuit scale of the shift register 33*a* will be much smaller than the conventional configuration with the twice-scale shift register.

Accordingly, for performing pre-charging of a signal supplying line with an internal pre-charging circuit by using a pre-charging power source having small driving ability, the foregoing configuration can provide a driver circuit of a display device capable of preventing fluctuation of a signal supplied to a different signal supplying line, while keeping the circuit scale of the shift register small.

Fourth Embodiment

Figure 7:
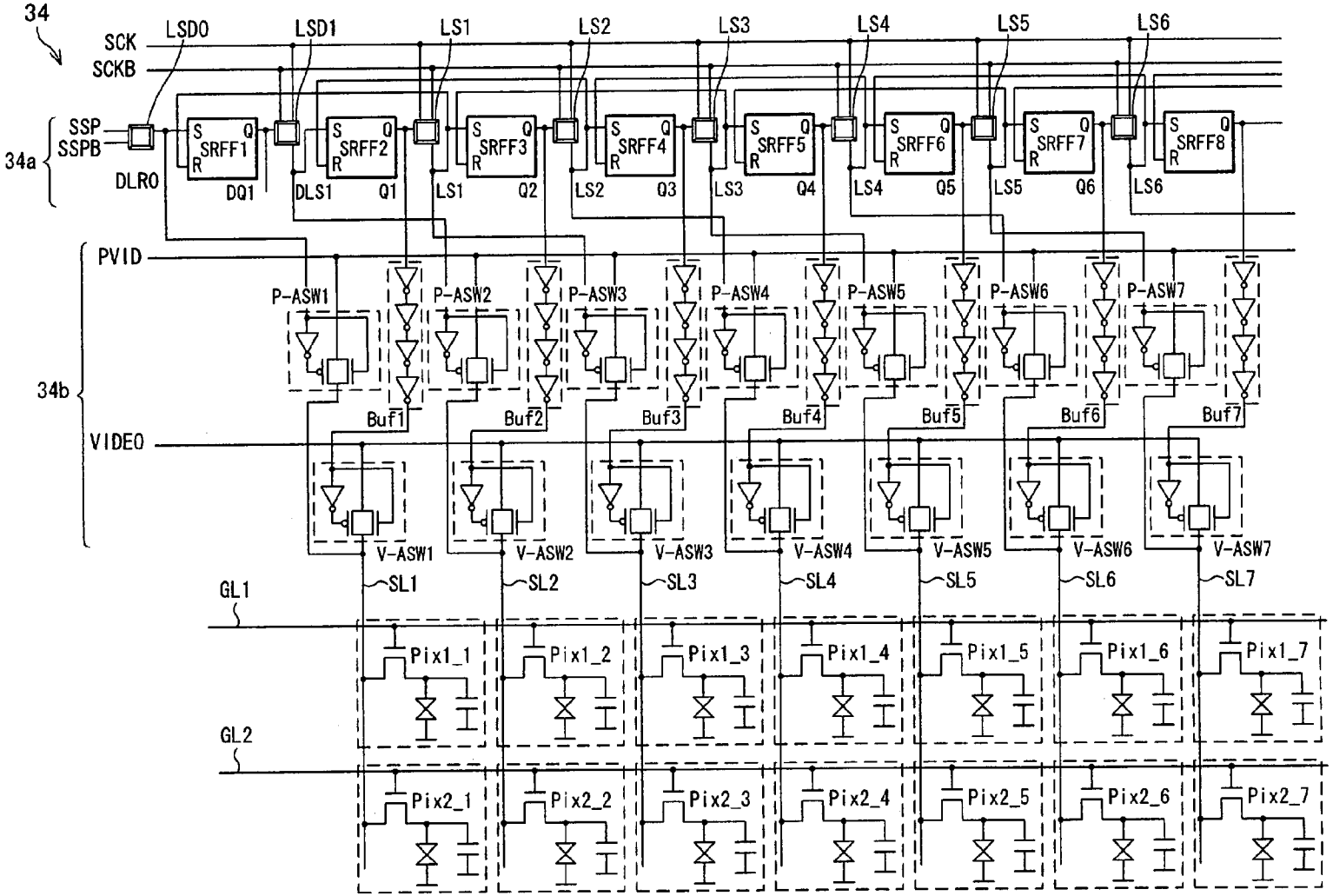
FIG. 7 is a circuit block diagram showing an arrangement of a data signal line driver according to Fourth Embodiment of the present invention.
Figure 8:
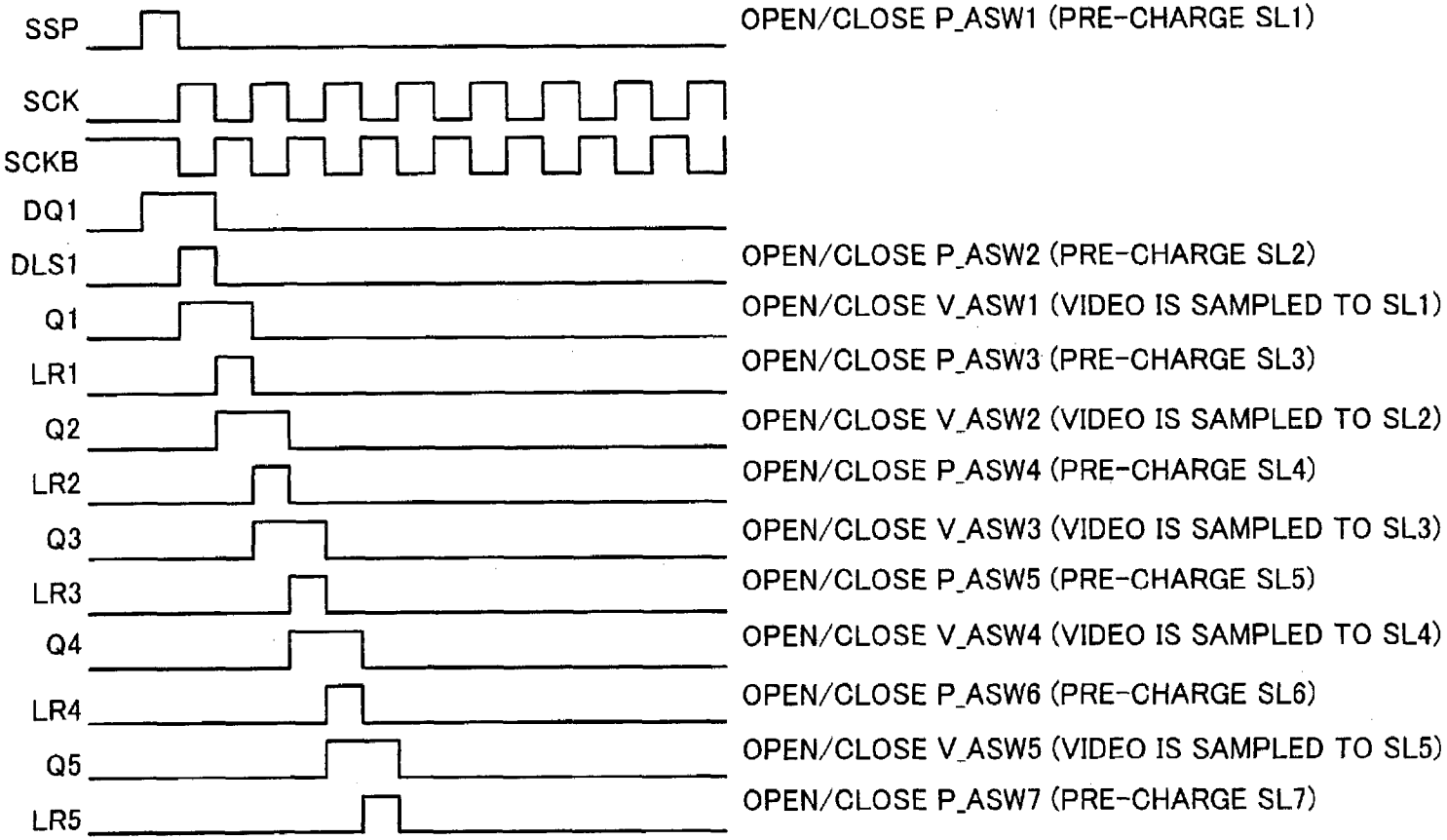
FIG. 8 is a timing chart of a signal regarding the operation of the data signal line driver of FIG. 7.

The following will explain a still another embodiment of the present invention with reference to FIGS. 7 and 8. For ease of explanation, materials having the equivalent functions as those shown in the drawings pertaining to First through Third Embodiments above will be given the same reference symbols, and explanation thereof will be omitted here.

The present embodiment uses a data signal line driver included in a liquid crystal display device, as a driver circuit of a display device of the present invention. FIG. 7 shows a configuration of a data signal line driver 34 as an example of such a data signal line driver.

The data signal line driver 34 includes a shift register 34*a* and a sampling section (writing circuit, pre-charging circuit) 34*b*.

The shift register 34*a* includes the flip-flops SRFFk (k=1, 2, . . . ) of FIG. 1 and level shift circuits LSD0, LSD1, LS1, LS2, . . . The level shift circuits LSD1, LS1, LS2, . . . are respectively used as replacements of the switch circuits ASW1, ASW2, ASW3, . . . The level shift circuits LSD1, LS1, LS2, . . . all have the same arrangements, and each of which receives clock signals SCK and SCKB upon input of High Q output of the flip-flop, and carries out level shift by using the signals. The level shift circuits LSD1, LS2, LS4, . . . carry out level shift of the waveform of the clock signal SCK, and the level shift circuits LSD1, LS1, LS3, . . . carry out level shift of the waveform of the clock signal SCKB. Further, the level shift circuits LSD1, LS1, LS2, . . . respectively output output signals DLS1, LR1, LR2, . . . (pre-charging control signal) as a result of the level shift. Each of these output signals is used as a set signal of the next stage flip-flop.

Further, the level shift circuit LSDO is supplied with start pulses SSP and SSPB so as to carry out level shift of the start pulse SSP inputted to the first stage flip-flop. The start pulse SSPB is an inversion signal of the start pulse SSP. The level shift circuit LSD0 carries out level shift of the start pulse SSP and outputs the start pulse as an output signal DLR0.

Namely, the data signal line driver 34 of the present embodiment is suitably used as a driver circuit of a display device supplied with external signals, such as clock signals SCK, SCKB, the start pulse signal SSP, whose voltage levels are low.

The sampling section 34*b* has the same internal arrangement as that of the sampling section 31*b*. The output signals DLS0, DLS1, LR1, LR2, . . . of the shift register 34*a* are respectively used as an input signal to the switches P-ASW1, P-ASW2, P-ASW3, P-ASW4, . . .

Further, a data signal line SLn (n=1, 2, . . . ), a scanning signal line SLm (m=1, 2, . . . ), and a pixel Pixm-n (m=1, 2, . . . , n=1, 2, . . . ) are the same as those of FIG. 1.

Figure 16:
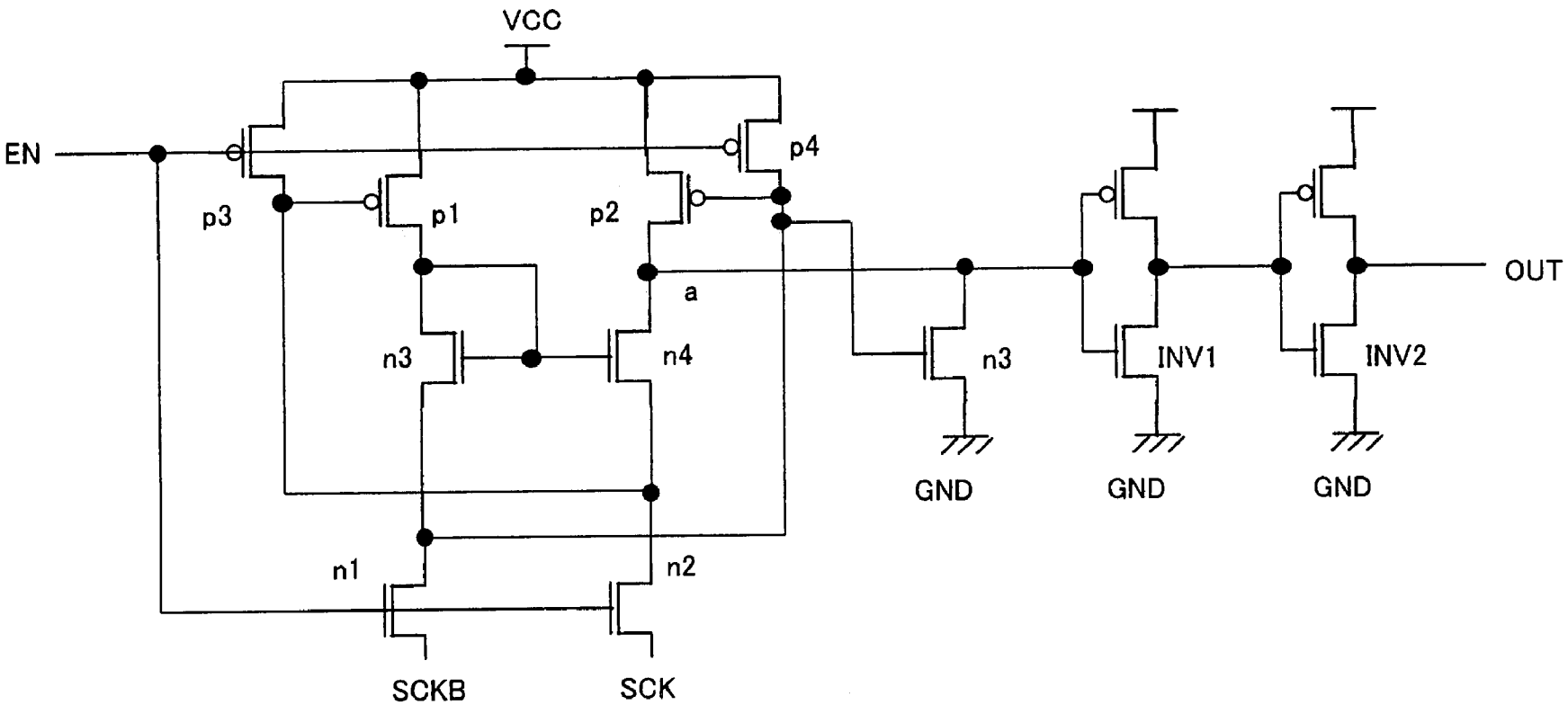
FIG. 16 is a circuit diagram showing an arrangement of an example of a level shift circuit.

Here, the following will explain an example of a level shift circuit which can be used as the level shift circuits LSD0, LSD1, LS1, LS2, . . . with reference to FIG. 16. FIG. 16 is a circuit diagram showing an arrangement of an example of the level shift circuit.

When the control signal EN, which is externally supplied, is HIGH, the level shift circuit externally receives the clock signals SCK and SCBK, and outputs the clock signal SCK after level shift as the output signal OUT. The control signal EN corresponds to the Q output of the flip-flop of FIG. 7. Further, the output signal OUT corresponds to the output signals DLS1, LR1, LR2, . . . of FIG. 7.

However, it should be noted that, when the level shift circuit is used as the level shift circuit LSD0, the start pulses SSP and SSPB are received instead of the clock signals SCK and SCKB, and the start pulse SSP is outputted after level shift as the output signal OUT.

The operation of the level shift circuit of FIG. 16 is controlled according to the control signal EN externally supplied. Further, the level shift circuit outputs a LOW signal as the output signal OUT whenever the control signal EN is LOW.

Figure 17:
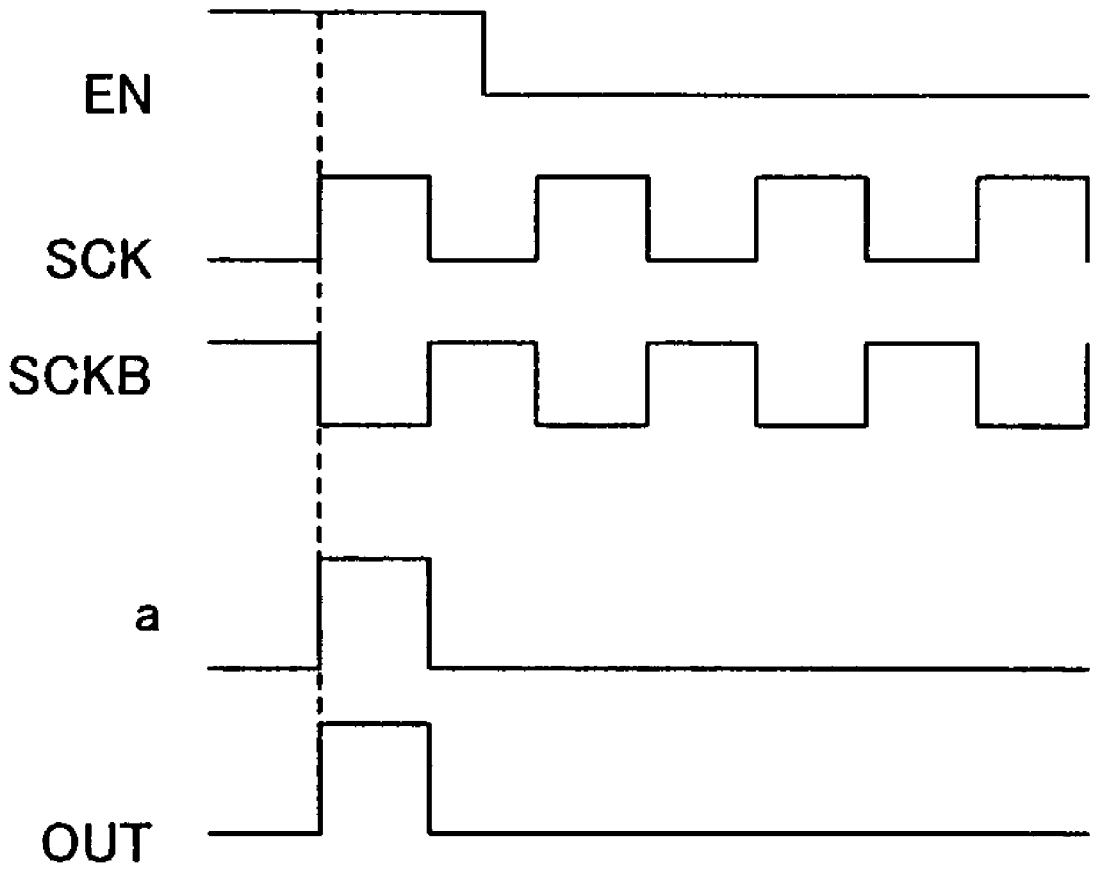
FIG. 17 is a timing chart showing waveforms of an input signal, a node signal and an output signal of the level shift circuit.

The following will explain the operation of the level shift circuit with reference to the symbols of FIG. 16 and the timing chart of FIG. 17. FIG. 17 is a timing chart showing waveforms of an input signal, a node signal and an output signal of the level shift circuit.

Here, when the control signal EN is HIGH and the clock signal SCK is HIGH as shown in the timing chart of FIG. 17, the pch transistors p3 and p4 are closed, and the nch transistors n1 and n2 are opened according to the control signal EN. Here, as the clock signal SCK is high, the node α is supplied with a HIGH signal via the pch transistor p2 by the pch transistors p1, p2, and the nch transistors n3, n4, and thus the node α becomes HIGH. Next, when the clock signal SCK becomes LOW, the node a is supplied with a LOW signal via the nch transistor n4, and thus the node α becomes LOW. Each potential (HIGH or LOW) of the node α are transmitted to the output end of the level shift circuit by the inverter circuits INV1 and INV2, and is outputted as the output signal OUT. This output signal emerges in the output end as the clock signal SCK which has already been processed by level shift.

Next, when the control signal EN is LOW, the pch transistors p3 and p4 are opened, and the nch transistors n1 and n2 are closed on the other hand. Here, a power source voltage VCC is supplied from the power source VCC to the gates of the nch transistors p1 and p2 via the pch transistors p3 and p4. As a result, the pch transistors p1 and p2 are closed, and therefore a current path from the power source VCC is cut off. Further, since the power source voltage VCC is also supplied to a gate of the nch transistor n3 as with the gates of the nch transistors p1 and p2, the nch transistor 3 is opened, and the node a becomes LOW. As a result, the output signal OUT of the level shift circuit becomes LOW. Accordingly, even when the clock signal lower in potential amplitude than the power source voltage VCC is supplied, the output signal OUT of the level shift circuit can still be obtained as a LOW signal. Further, since the current path from the power source VCC is cut off when the control signal EN is LOW, it becomes possible to suppress unnecessary power consumption.

Figure 18:
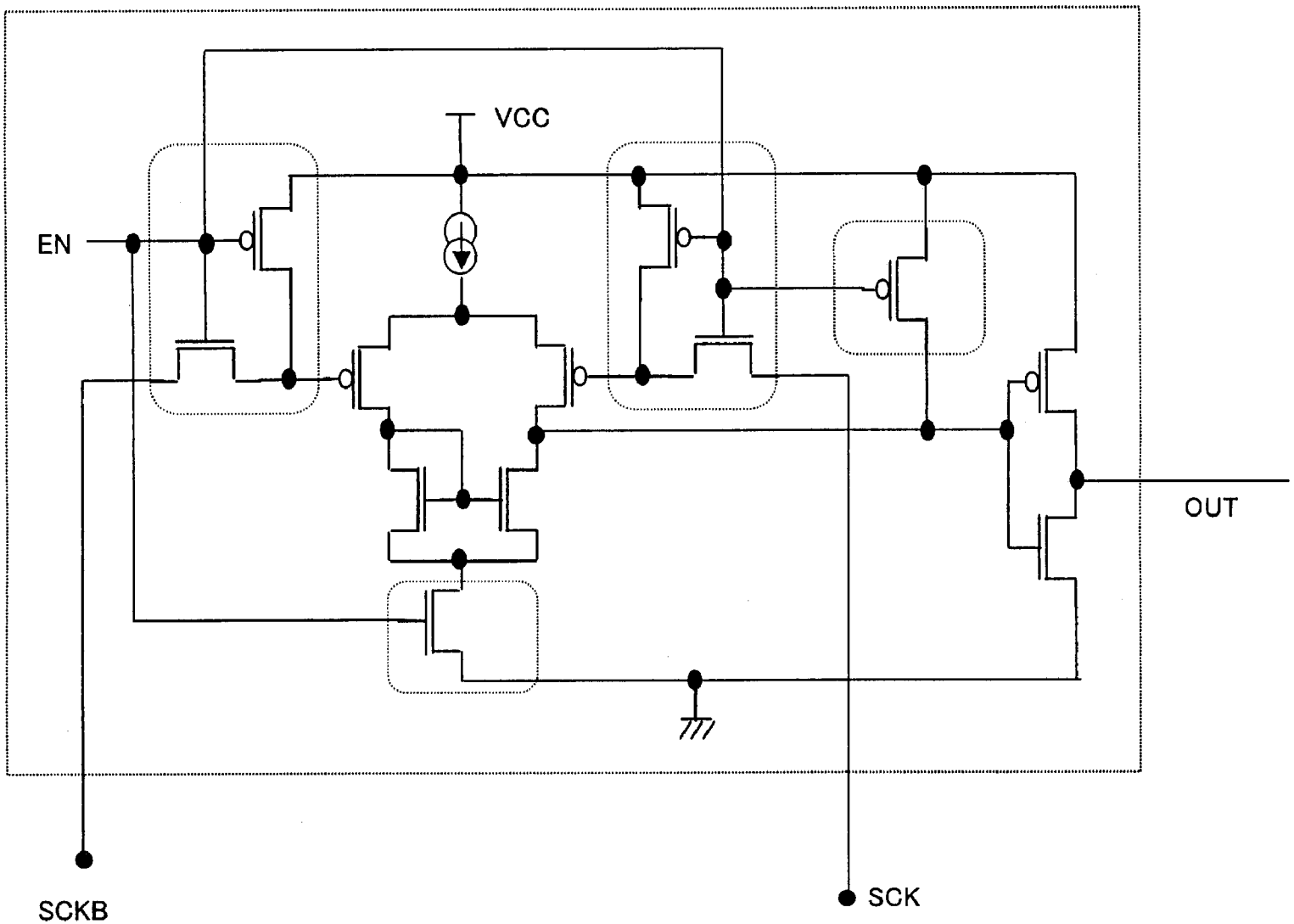
FIG. 18 is a circuit diagram showing an arrangement of another example of the level shift circuit.

Further, a level shift circuit having the arrangement shown in FIG. 18 also ensures the same effect as that of the level shift circuit of FIG. 16 though explanation of the operation thereof is omitted here. Note that, FIG. 18 is a circuit diagram showing an arrangement of another example of the level shift circuit.

Next, the following will explain an operation of the data signal line driver 34 having the foregoing configuration with reference to the timing chart shown in FIG. 8.

The following will explain 1 period which is a time period during a scanning line GLm is selected. In this period, when carrying out pre-charging to the data signal line SL, both the data signal line SL and a pixel selected and connected to the data signal line SL are pre-charged, as the scanning signal line GLm is selected. Upon input of the start pulses SSP and SSPB, the level shift circuit LSD0 carries out level shift of these signals, and outputs an output signal DLR0. As a result, an output signal DQ1 is outputted from the flip-flop SRFF1, and also the start pulse SSP is supplied to the switch P-ASW1. This brings the switch P-ASW1 into conduction, and the pre-charging potential PVID is applied to the data signal line SL1, and pre-charging is carried out with respect to both the data signal line SL1 and the capacitance of the selected pixel. Here, since the switch V-ASW1 is non-conductive, the pre-charging potential PVID will not disturb the video signal VIDEO on the data signal line SL1.

Further, the level shift circuit LSD 1 receives the clock signals SCK and SCKB upon input of the output signal DQ1, and caries out level shift of the clock signal SCK, and then outputs an output signal DLS1. The output signal DLS1 is used as a set signal of the flip-flop SRFF2, and the flip-flop SRFF2 outputs an output signal Q1. The level shift circuit LS1 receives the clock signals SCKB and SCK upon input of the output signal Q1, and caries out level shift of the clock signal SCKB, and then outputs an output signal LR1. Further, the output signal Q1 operates as a timing pulse and brings the switch V-ASW1 into conduction via the buffer Buf 1. As a result, the data signal line SL1 is supplied with the video signal VIDEO, and the data signal line SL1 and the pixel capacitance are charged to a predetermined voltage. More specifically, the video signal VIDEO is sampled, and a sampling effective period (writing effective period) is started. In this sampling effective period, the respective data signal lines in the predetermined period are sequentially sampled.

Since the start pulse SSP and the output signal DLR0 become low by this stage, the switch P-ASW1 is non-conductive, and therefore the pre-charging potential PVID will not disturb the video signal VIDEO on the data signal line SL1. Further, the output signal DLS1 brings the switch P-ASW2 into conduction, and therefore, the video signal VIDEO is outputted to the data signal line SL1, and simultaneously, the data signal line SL2 and the pixel capacitance are pre-charged. Meanwhile, since the output signal LR1 operates as a reset signal of the flip-flop SRFF1, the output signal DQ1 of the flip-flop SRFF1 becomes low. As a result, the level shift circuit LSD1 stops the level shift operation.

Note that, in case of adopting D flip-flops connected in a state of cascade connection for constituting the shift register, both the input signal and the output signal of each flip-flop are required for controlling enforcement and stopping of the operation of the level shift circuits. In contrast, since the shift register 34*a* of the present embodiment uses set-reset flip-flops, only the output signal of the preceding flip-flop is required for controlling execution and cessation of the operation of the level shift circuits, thus realizing a simpler structure.

In such a manner, the sampling is carried out in a point-at-a-time method by sequentially repeating such an operation that the video signal VIDEO is supplied to the data signal line SLn after the pre-charging of the data signal line SLn, and while the data signal line SLn is supplied with the video signal VIDEO, the data signal line SL (n+1) is pre-charged. This operation corresponds to the operation of the timing pulse, which is sequentially transferred in the shift register toward a later stage flip-flop by the flip-flop SRFFk and the respective shift registers. As shown in FIG. 8, two adjacent sampling periods overlap each other by a half period of the clock signals SCK and SCKB. In this case, the sampling potential is determined by the pixel capacitance and the pre-charging potential of the data signal line at a falling phase of the timing pulse in the respective sampling periods.

The above-mentioned sampling effective period is a time period until the sampling of the last-stage data signal line driver SL is finished, and the pre-charging of the data signal line not sampled in this period is performed as follows: the clock signals SCK and SCKB supplied from a source different to that of the timing pulse are received and outputted by the level shift circuits LSD1, LS1, LS2, . . . , and the switch P-ASWn becomes conductive with the charging of the control terminal (gate G'). In order to constantly carry out such a pre-charging in the sampling effective period, the total number of the level shift circuits LSD1, LS1, LS2, . . . is equal to the number of the data signal lines SL pre-charged in the sampling effective period. This level shift circuit may be replaced to other means for carrying out pre-charging other than the sampling effective period (for example, pre-charging of the data signal line SL1).

With the foregoing manner, it is possible to carry out sampling of the video signal VIDEO with respect to the data signal line SL, while carrying out pre-charging of other data signal line SL. Further, here, since the timing pulse for the sampling is supplied from a different system to the system from which the signal for pre-charging is supplied, the control signal circuit of the switch V-ASW and the control signal circuit of the switch P-ASW will not be provided as one circuit. On this account, it is possible to prevent such a phenomenon that a large current flowing into the data signal line SL with the pre-charging causes fluctuation of the potential of the video signal VIDEO of the data signal line SL subjected to writing at the time, via the capacitive control terminal (gate G') of the switch P-ASW. Further, since the respective level shift circuits LSD1, LS1, LS2, . . . and the level shift circuit LSD0 for receiving and outputting the clock signals SCK and SCKB after the level shift can be composed in a simpler structure than that of the flip-flop, the circuit scale of the shift register 34*a* will be much smaller than the conventional configuration with the twice-scale shift register.

Accordingly, for performing pre-charging of a signal supplying line with an internal pre-charging circuit by using a pre-charging power source having small driving ability, the foregoing configuration can provide a driver circuit of a display device capable of preventing fluctuation of a signal supplied to a different signal supplying line, while keeping the circuit scale of the shift register small.

Further, as it may be recognized with the present embodiment using a low voltage signal as the clock signal supplied to the level shift circuit, the level shift circuit has a function as a low voltage interface, thereby reducing power consumption of the external circuit which generates the clock signal.

Note that, in contrast to the patent document 5 and the patent document 6, the present embodiment introduces a totally new idea such that the control signal for carrying out pre-charging of the data signal line is generated by carrying out level shift of the clock signal, and the pre-charging potential is supplied to a switch connected to the data signal line.

Fifth Embodiment

Figure 9:
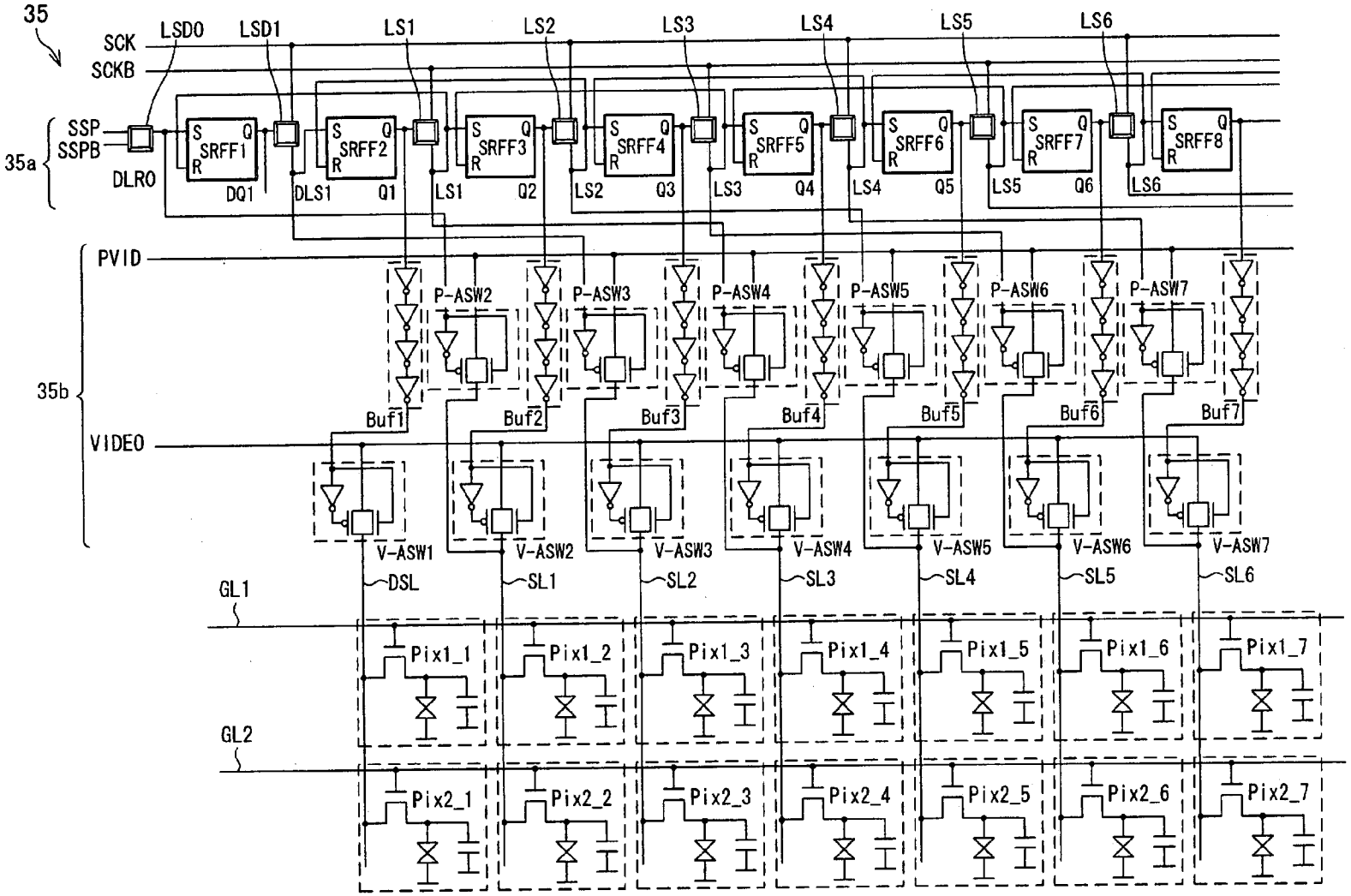
FIG. 9 is a circuit block diagram showing an arrangement of a data signal line driver according to Fifth Embodiment of the present invention.
Figure 10:
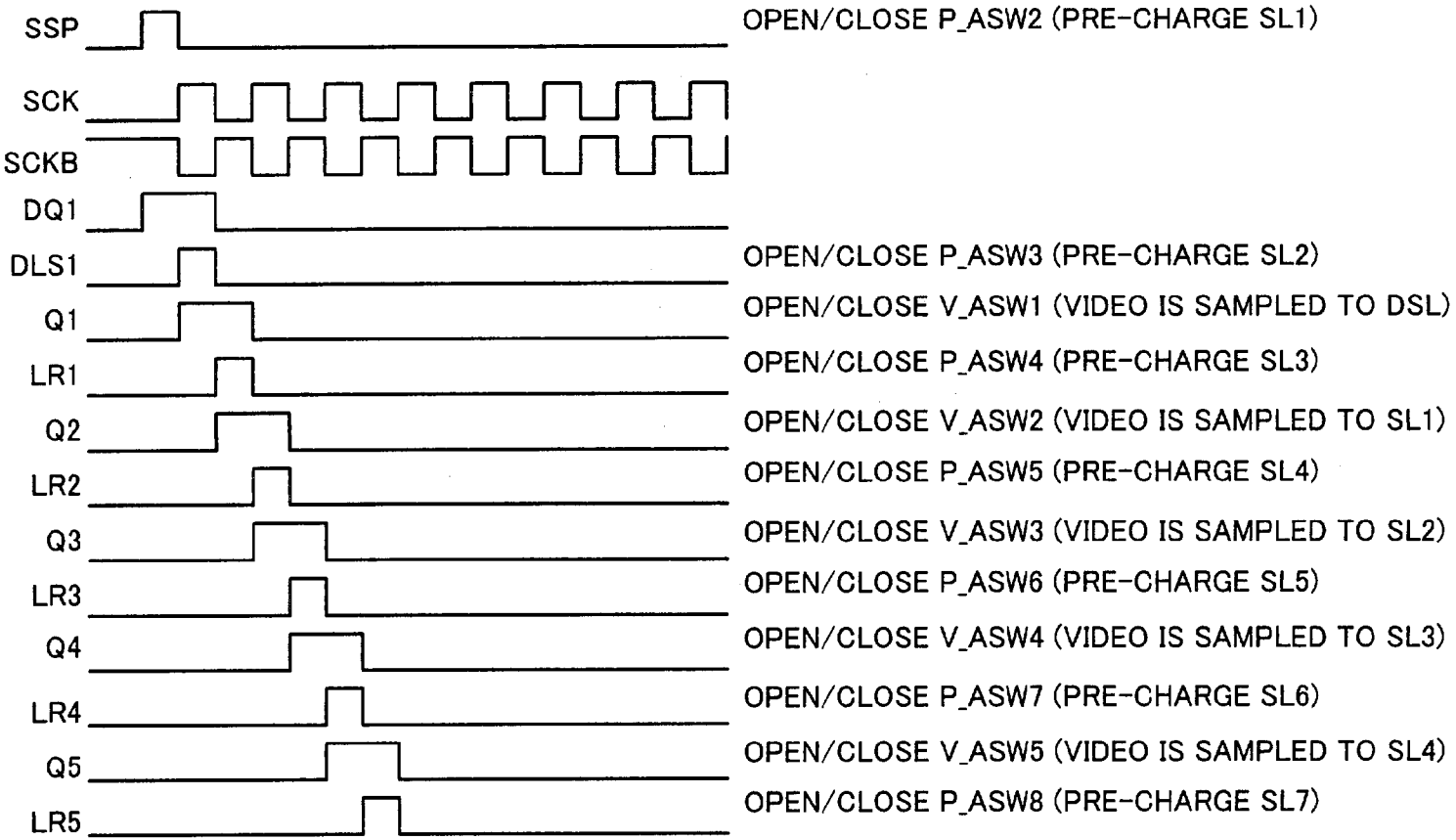
FIG. 10 is a timing chart of a signal regarding the operation of the data signal line driver of FIG. 9

The following will explain a further embodiment of the present invention with reference to FIGS. 9 and 10. For ease of explanation, materials having the equivalent functions as those shown in the drawings pertaining to First through Fourth Embodiments above will be given the same reference symbols, and explanation thereof will be omitted here.

The data signal line driver 35 includes a shift register 35*a* and a sampling section (writing circuit, pre-charging circuit) 35*b*.

The shift register 35*a* has the same internal arrangement as that of the shift register 35*a*; however, in this shift register 35*a*, the signal for pre-charging is outputted to a different switch. The output signal DLR0 used as a set signal of the flip-flop SRFF1 is inputted to the switch P-ASW2 as a signal for pre-charging. Further, the output signal DLS1 is supplied to the switch P-ASW3. Further, the output signals LR1, LR2, . . . are supplied to the switches P-ASW4, P-ASW5, . . .

In contrast to the sampling section 34*b* shown in FIG. 7, the sampling section 35*b* does not include the switch P-ASW1. Further, the data signal line SL1 of FIG. 7 is replaced to a dummy data signal line DSL, and the data signal lines SL2, SL3 . . . of FIG. 7 are replaced to the data signal lines SL1, SL2 . . . in FIG. 9. Further, the pixel connected to the data signal line DSL is replaced to a dummy pixel m-D (m=1, 2, . . . ), and therefore, the pixels connected to the data signal lines SL1, SL2, . . . are shifted by the dummy pixel in a horizontal direction. Namely, the data signal line driver 35 of the present embodiment is suitably used as a driver circuit of a display device including a dummy data signal line and a dummy pixel.

FIG. 10 is a timing chart showing an operation of the data signal line driver 35 having the foregoing arrangement. Since the signal transmission principle is the same as that of the case of FIG. 7, a minute explanation is omitted. The characteristic of this data line signal driver 35 is that the end of the pre-charging and the beginning of the sampling are different by a half period of the clock signals SCK and SCKB in the same data signal line SL. Specifically, the sampling with respect to the data signal line SL1 is carried out when a half period of the clock signal SCK and SCKB is elapsed after the pre-charging of the data signal line SL1 with the conduction of the switch P-ASW2 by the start pulse SSR.

On this account, in addition to the effect described in Forth Embodiment, it is possible to unfailingly prevent the pre-charging potential PVID and the video signal VIDEO from disturbing each other, thus improving display quality. Note that, since the dummy pixel is generally provided under a light blocking body called black matrix, the display of the dummy pixel does not appear on the screen. Therefore, pre-charging of the dummy pixel and the dummy data signal line are not necessary.

Sixth Embodiment

Figure 11:
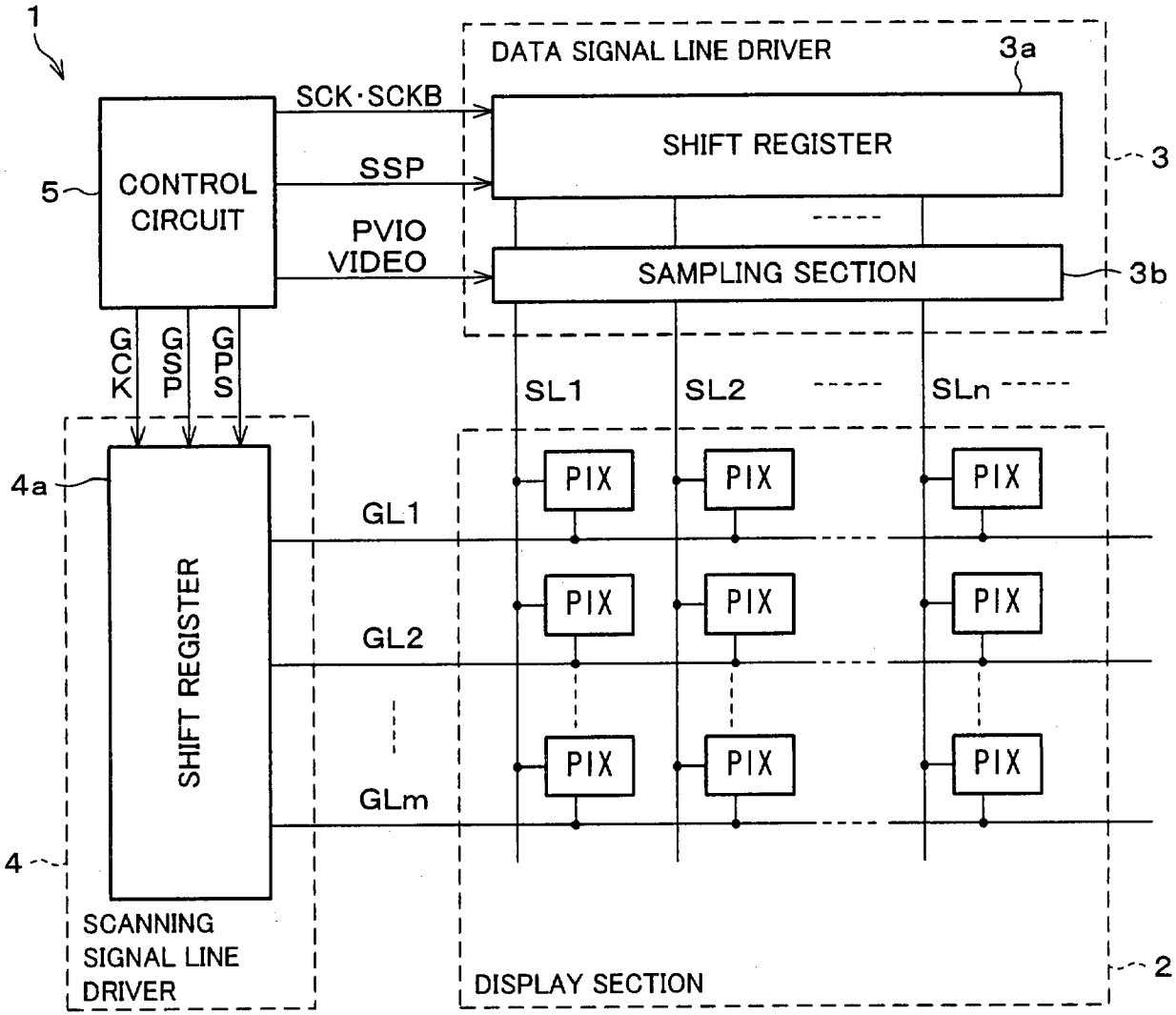
FIG. 11 is a circuit block diagram showing an arrangement of a display device according to Sixth Embodiment of the present invention.

The following will explain a still further embodiment of the present invention with reference to FIG. 11. For ease of explanation, materials having the equivalent functions as those shown in the drawings pertaining to First through Fifth Embodiments above will be given the same reference symbols, and explanation thereof will be omitted here.

FIG. 11 shows a liquid crystal display device 1 as a display device according to the present embodiment.

The liquid crystal display device 1 is an active matrix type liquid crystal display device which is driven in a point-at-a-time method by alternating driving. The liquid crystal display device 1 includes a display section 2 having pixels Pix aligned in a matrix manner, a data signal line driver 3 and a scanning signal line driver 4 for driving the pixels Pix, a control circuit 5, data signal lines SL, and scanning signal lines GL. The control circuit 5 generates a video signal VIDEO which shows a display state of each pixel Pix, so as to carry out image display based on the video signal VIDEO.

Here, the display section 2 is the same as the Pixm-n (m=1, 2, . . . , n=1, 2, . . . ) and the dummy pixel, which are described in First through Fifth Embodiments. The data signal line driver 3 is made according to one of data signal line drivers 31 through 35 described in First through Fifth Embodiments. A shift register 3*a* and a sampling section (writing circuit, pre-charging circuit) 3*b* included in the data signal line driver 3 correspond to the shift registers 31*a* through 35*a*, and the sampling sections 31*b* through 35*b* described in First through. Fifth Embodiments.

Further, the scanning signal line driver 4 is a circuit for sequentially driving the scanning signal line GLn described in First through Fifth Embodiments, and selects the MOSFET (TFT) of the pixel connected to the scanning signal line GLn. Further, the scanning signal line driver 4 includes a shift register 4 which transfers a timing signal for sequentially carrying out the selection of the scanning signal line GLn.

The display section 2, the data signal line driver 3, and the scanning signal line driver 4 are provided on one substrate for reduction of both manufacturing labor and wiring capacitance. Further in order to integrate as many pixels Pix as possible, and to enlarge the display area, the display section 2, the data signal line driver 3, and the scanning signal line driver 4 are constituted of a polycrystalline silicon thin film transistor formed on a glass substrate. Further, upon adoption of a general glass substrate (the strain point is at or less than 600°), the polycrystalline silicon thin film transistor is manufactured with a process temperature of not more than 600° so as to avoid warping or bending caused by a process temperature of at or more than the strain point.

Further, the control circuit 5 generates a clock signals SCK and SCKB, a start pulse SSR, a pre-charging potential PVID, and a video signal VIDEO, and outputs these signals to the data signal line driver 3. Further, the control circuit 5 generates a clock signal GCK, a start pulse GSP, and a signal GPS, and outputs these signals to the scanning signal line driver 4.

With the configuration above, the liquid crystal display device 1 can provides the effects described in First through Fifth Embodiments, thereby carrying out display with high display quality.

Further, the display device of the present invention is not limited to a liquid crystal display device but may be any display devices requiring charging of the wiring capacitance, such as an organic EL display device.

Seventh Embodiment

The following will explain a yet further embodiment of the present invention with reference to FIGS. 12 through 15. Note that, for ease of explanation, materials having the equivalent functions as those shown in the drawings pertaining to First through Sixth Embodiments above will be given the same reference symbols, and explanation thereof will be omitted here.

The driver circuits for a display device described in First through Fifth Embodiment adopt a so-called point-at-a-time driving method which sequentially carries out writing with respect to a plurality of data signal lines. For example, in case of the driver circuit in a display device of First Embodiment, the output Q of the shift register for controlling conduction and non-conduction of the switch V-ASW for sampling, and the signal SR used for controlling conduction and non-conduction of the switch P-ASW for pre-charging and also used as a set signal of the next stage flip-flop SRFF constituting the shift register, are both related to a switch of one system; however, as shown in FIG. 12, the present invention may also be adopted for 3-system sampling with RGB signals.

Figure 12:
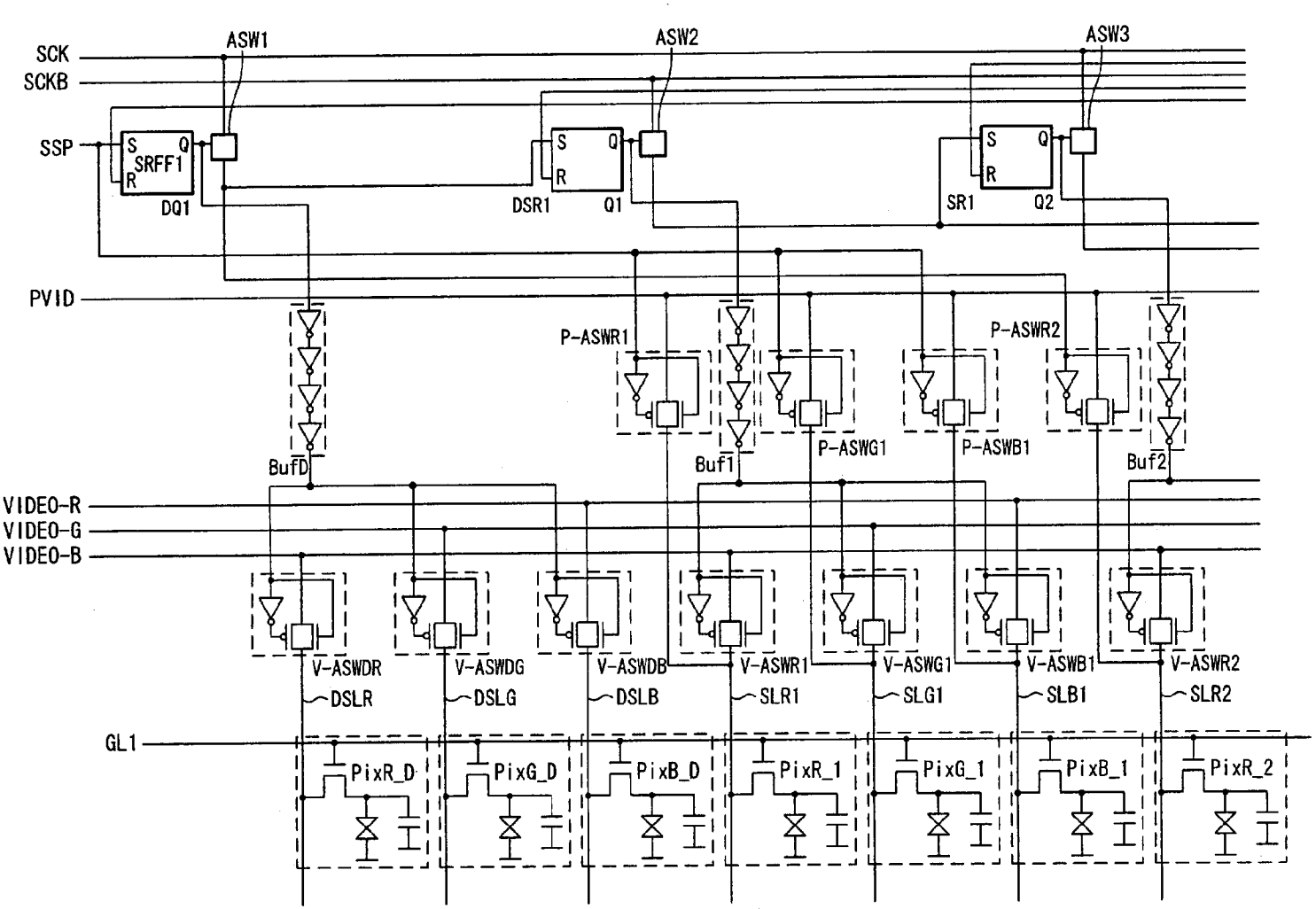
FIG. 12 is a circuit block diagram showing an arrangement of a data signal line driver according to Seventh Embodiment of the present invention.
Figure 13:
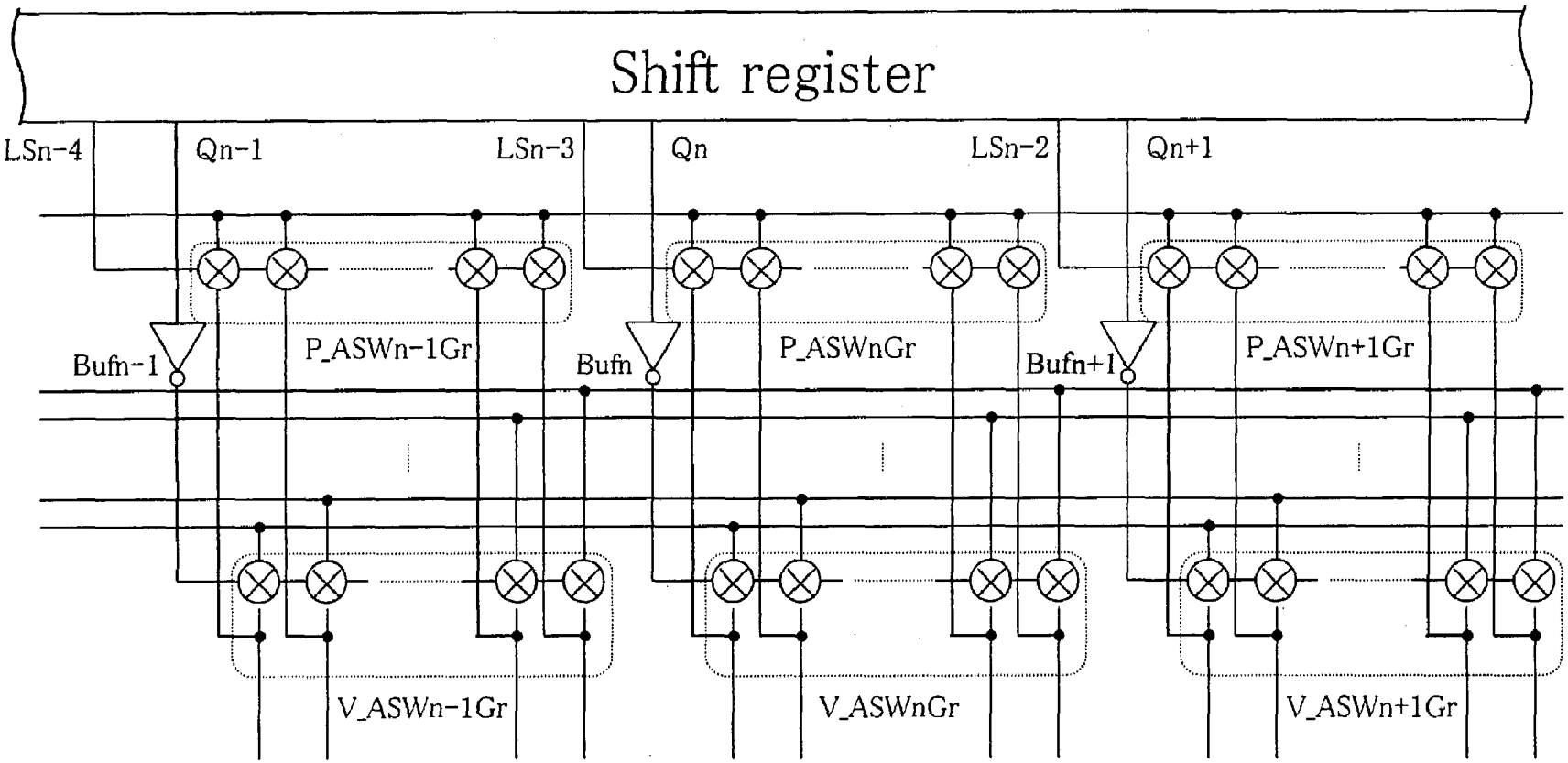
FIG. 13 is a circuit block diagram showing an arrangement of another data signal line driver according to Seventh Embodiment of the present invention.
Figure 14:
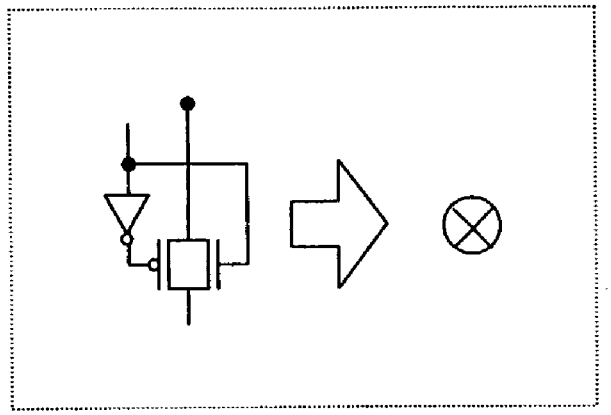
FIG. 14 is a circuit block diagram showing an arrangement of a part of the data signal line driver according to Seventh Embodiment of the present invention.
Figure 15:
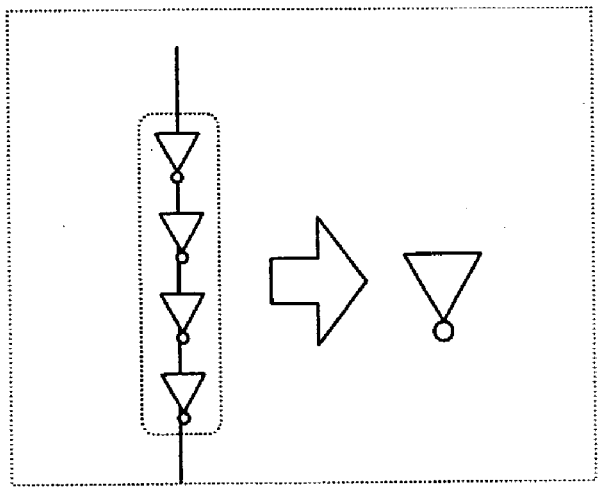
FIG. 15 is a circuit block diagram showing an arrangement of a part of a data signal line driver according to Seventh Embodiment of the present invention.

Further, as shown in FIG. 13, the present invention may also be adopted for such an arrangement that the video signal is supplied by using plural systems so as to delay the sampling period. Note that, since FIG. 13 is a simplified drawing, the switch for pre-charging and the switch for actual sampling are denoted by different symbols to those in FIG. 12; however, the actual switches are identical to those of FIG. 12 as shown in FIG. 14. Similarly, though the buffer group for driving the analog switch for the actual sampling is shown by different symbols in FIG. 13 to those in FIG. 12, the actual buffer group is identical to that of FIG. 12 as shown in FIG. 15. Similarly, the actual shift register has a similar arrangement as that of FIG. 12. However, it should be noted that the driving ability of the buffer group has to be sufficient with respect to the number of systems for pre-charging and sampling.

Here, in the configuration shown in FIGS. 12 and 13 which carries out sampling of i (i is an integer not less than 2) systems with the units of i signal supplying lines, it is arranged so that the switches for sampling sequentially become conductive in the units, and the switches included in each of the units simultaneously become conductive, and also the number of switch circuits corresponds to the number of the signal supplying lines, and the switches for pre-charging also sequentially become conductive in the units of i signal supplying lines, and simultaneously become conductive in each of the units. The operation of this configuration is basically the same as that of 1-system configuration; however, in this configuration, the plurality of pre-charging switches become conductive at the same time and also the plurality of sampling switches become conductive at the same time. Further, the present invention is not limited to the examples of FIGS. 12 and 13, and the driver circuits for a display device shown in FIGS. 1 through 5 can adopt the sampling method and pre-charging method using plural systems shown in FIGS. 12 and 13.

As has been described, a driver circuit according to the present invention is a driver circuit for a display device having a plurality of signal supplying lines; the driver circuit includes: a writing circuit having a plurality of first switches for each of the signal supplying lines so as to carry out writing of a write signal into the signal supplying lines by bringing the first switches into conduction, the first switches being controlled between a conductive state and a non-conductive state according to a voltage of a first control terminal which is capacitive; a shift register having a plural stages of flip-flops for outputting a timing pulse used for the writing toward the first control terminal so that the timing pulse is sequentially transferred through the flip-flops so as to carry out the writing at predetermined cycles; and a pre-charging circuit having a plurality of second switches for each of the signal supplying lines so as to carry out pre-charging of the signal supplying lines by bringing the second switches into conduction, the second switches being controlled between a conductive state and a non-conductive state according to a voltage of a second control terminal which is capacitive, while the writing is carried out with respect to a part of the signal supplying lines, the pre-charging circuit carrying out the pre-charging of at least one of the remaining signal supplying lines, and the shift register including control signal supplying circuits which output a pre-charging control signal for controlling the second switches to the second control terminal via a second signal line which is separated from a first signal line which transmits the timing pulse to the first control terminal.

With this arrangement, the first switch operating as a writing circuit is controlled by a timing pulse supplied from a set-reset flip-flop, and the second switch operating as a pre-charging circuit is controlled by a pre-charging control signal supplied from a control signal supplying circuit.

Further, the foregoing arrangement allows writing of a write signal into a part of the signal supplying lines by the writing circuit, while carrying out pre-charging of a different part of the signal supplying lines. Further, here, since a pre-charging control signal for controlling conduction of the second switch is supplied to the second switch via the second signal line which is separated from the first signal line for supplying a timing pulse to the first control terminal, the system for supplying the timing pulse used for the writing by the writing circuit to the first switch is separated from the system for supplying the pre-charging control signal for controlling conduction of the second switch of the pre-charging circuit to the second switch. Thus, the control signal circuit of the first switch and the control circuit of the second switch are not provided as one circuit. On this account, it is possible to prevent such a phenomenon that a large current flowing into the signal supplying line upon the pre-charging causes fluctuation of the potential of the write signal of the signal supplying line subjected to writing at the time, via the capacitive first control terminal of the first switch and the capacitive second control terminal of the second switch. Further, since the control signal supplying circuit, which outputs a pre-charging control signal for controlling conduction of the second switch to the second control terminal, can be composed in a simpler structure than that of the flip-flop, the circuit scale of the shift register will be much smaller than the conventional configuration with the twice-scale shift register.

Accordingly, for performing pre-charging of a signal supplying line with an internal pre-charging circuit by using a pre-charging power source having small driving ability, the foregoing configuration can provide a driver circuit of a display device capable of preventing fluctuation of a signal supplied to a different signal supplying line, while keeping the circuit scale of the shift register small.

The driver circuit according to the present invention may be arranged so that, upon input of the timing pulse from the flip-flop in a writing effective period, which is a period for carrying out the writing during the predetermined cycle, the control signal supplying circuits bring the second switches into conduction by receiving a clock signal supplied from a signal source different from a signal source for supplying the timing pulse, and outputting a pre-charging control signal synchronized with the clock signal to the second control terminal corresponding to a predetermined one of the signal supplying lines which is not subjected to the writing, and the control signal supplying circuits are provided according to a number of the signal supplying lines pre-charged in the writing effective period.

With this arrangement, the writing is sequentially carried out with respect to the respective signal supplying lines in the writing effective period, and when the flip-flop outputs a timing pulse, the switch circuit is supplied with the timing pulse from the flip-flop of the preceding stage, and receives a clock signal and outputs a control signal synchronized with the clock signal toward the control terminal of the second switch, so as to carry out pre-charging of a signal supplying line which is not subjected to the writing. This allows the writing of a write signal into the signal supplying line, while carrying out pre-charging of a different signal supplying line. Further, since the clock signal to be outputted is received from a different source, the circuit scale can be reduced.

The driver circuit according to the present invention may be arranged so that the flip-flops are set-reset flip-flops, and the control signal supplying circuits are switch circuits for outputting the clock signal as the pre-charging control signal, and each of the switch circuits outputs the clock signal also as a set signal transferred to a set-reset flip-flop next to the set-reset flip-flop outputting the timing pulse, and the set-reset flip-flop uses the set signal as a reset signal of a preceding set-reset flip-flop of the set-reset flip-flop.

Namely, as described, the driver circuit for a display device according to the present invention includes: a writing circuit having a plurality of first switches for each of the signal supplying lines so as to carry out writing of a write signal into the signal supplying lines by bringing the first switches into conduction, the first switches being controlled between a conductive state and a non-conductive state according to a voltage of a first control terminal which is capacitive; a shift register having a plural stages of flip-flops for outputting a timing pulse used for the writing toward the first control terminal so that the timing pulse is sequentially transferred through the flip-flops so as to carry out the writing at predetermined cycles; and a pre-charging circuit having a plurality of second switches for each of the signal supplying lines so as to carry out pre-charging of the signal supplying lines by bringing the second switches into conduction, the second switches being controlled between a conductive state and a non-conductive state according to a voltage of a second control terminal which is capacitive, wherein: the flip-flops are set-reset flip-flops, and upon input of the timing pulse from the flip-flop in a writing effective period, which is a period for carrying out the writing during the predetermined cycle, the shift register brings the second switches into conduction by receiving a clock signal supplied from a signal source different from a signal source for supplying the timing pulse, and outputting a pre-charging control signal synchronized with the clock signal to the second control terminal corresponding to a predetermined one of the signal supplying lines which is not subjected to the writing, and the control signal supplying circuits are provided according to a number of the signal supplying lines pre-charged in the writing effective period, and each of the switch circuits outputs the clock signal also as a set signal transferred to a set-reset flip-flop next to the set-reset flip-flop outputting the timing pulse, and the set-reset flip-flop uses the set signal as a reset signal of a preceding set-reset flip-flop of the set-reset flip-flop.

With this arrangement, the first switch of the writing circuit becomes conductive when the control terminal is charged by the output of the timing pulse for writing a write signal from the set-reset flip-flop, and meanwhile, the second switch of the writing circuit becomes conductive when the control terminal is charged by the receive and output of the clock signal, which is supplied from a different source from that of the timing pulse, by the switch circuit. The writing is sequentially carried out with respect to the respective signal supplying lines in the writing effective period, and when the set-reset flip-flop outputs a timing pulse, the switch circuit is supplied with the timing pulse from the set-reset flip-flop of the preceding stage, and receives a clock signal and outputs a control signal synchronized with the clock signal, so as to carry out pre-charging of the signal supplying lines which is not subjected to the writing.

Further, each of the switch circuits outputs the received clock signal as a set signal transferred to a set-reset flip-flop next to the set-reset flip-flop which has been supplied with the timing pulse, and each of the set-reset flip-flops uses the supplied set signal as a reset signal of the preceding set-reset flip-flop. As a result, the timing pulse may be sequentially transferred.

As described, the foregoing arrangement allows writing of a write signal into a part of the signal supplying lines by the writing circuit, while carrying out pre-charging of a different part of the signal supplying lines. Further, here, the system for supplying the timing pulse used for the writing is separated from the system for supplying the pre-charging control signal. Thus, the control signal circuit of the first switch and the control circuit of the second switch are not provided as one circuit. On this account, it is possible to prevent such a phenomenon that a large current flowing into the signal supplying line upon the pre-charging causes fluctuation of the potential of the write signal of the signal supplying line subjected to writing at the time, via the capacitive control terminal of the switch. Further, since the switch circuit for receiving and outputting the clock signal can be composed in a simpler structure than that of the flip-flop, the circuit scale of the shift register will be much smaller than the conventional configuration with the twice-scale shift register.

Accordingly, for performing pre-charging of a signal supplying line with an internal pre-charging circuit by using a pre-charging power source having small driving ability, the foregoing configuration can provide a driver circuit of a display device capable of preventing fluctuation of a signal supplied to a different signal supplying line, while keeping the circuit scale of the shift register small.

Further, the driver circuit having the foregoing arrangement may further be arranged so that the flip-flops are D flip-flops which use an output signal as an input signal of a next stage, and the D flip-flop is supplied with a clock signal which is supplied from a signal source different from a signal source for supplying the timing pulse, and the control signal supplying circuits are switch circuits for outputting the clock signal as the pre-charging control signal.

Namely, as described, a driver circuit for a display device according to the present invention includes: a writing circuit having a plurality of first switches for each of the signal supplying lines so as to carry out writing of a write signal into the signal supplying lines by bringing the first switches into conduction, the first switches being controlled between a conductive state and a non-conductive state according to a voltage of a first control terminal which is capacitive; a shift register having a plural stages of flip-flops for outputting a timing pulse used for the writing toward the first control terminal so that the timing pulse is sequentially transferred through the flip-flops so as to carry out the writing at predetermined cycles; and a pre-charging circuit having a plurality of second switches for each of the signal supplying lines so as to carry out pre-charging of the signal supplying lines by bringing the second switches into conduction, the second switches being controlled between a conductive state and a non-conductive state according to a voltage of a second control terminal which is capacitive, wherein: the flip-flops are D flip-flops which use an output signal as an input signal of a next stage, and the D flip-flop is supplied with a clock signal which is supplied from a signal source different from a signal source for supplying the timing pulse, and the shift register includes a switch circuit which brings the second switches into conduction upon input of the timing pulse from the D flip-flop in a writing effective period, which is a period for carrying out the writing during the predetermined cycle, by receiving the clock signal and also outputting the clock signal to the control terminal of the second switch corresponding to a predetermined one of the signal supplying lines which is not subjected to the writing, and the control signal supplying circuits are provided according to the number of the signal supplying lines pre-charged in the writing effective period.

With this arrangement, the first switch of the writing circuit becomes conductive when the control terminal is charged by the output of the timing pulse for writing a write signal from the D flip-flop, and meanwhile, the second switch of the writing circuit becomes conductive when the control terminal is charged by the receive and output of the clock signal for D flip-flop, which is supplied from a different source from that of the timing pulse, by the switch circuit. The writing is carried out with respect to the respective signal supplying lines in the writing effective period, and when the D flip-flop outputs a timing pulse, the switch circuit is supplied with the timing pulse from the D flip-flop of the preceding stage, and receives a clock signal and outputs a control signal synchronized with the clock signal, so as to carry out pre-charging of the signal supplying lines which is not subjected to the writing.

Therefore, the foregoing arrangement allows writing of a write signal into a part of the signal supplying lines by the writing circuit, while carrying out pre-charging of a different part of the signal supplying lines. Further, here, the system for supplying the timing pulse used for the writing is separated from the system for supplying the pre-charging control signal. Thus, the control signal circuit of the first switch and the control circuit of the second switch are not provided as one circuit. On this account, it is possible to prevent such a phenomenon that a large current flowing into the signal supplying line upon the pre-charging causes fluctuation of the potential of the write signal of the signal supplying line subjected to writing at the time, via the capacitive control terminal of the switch. Further, since the switch circuit for receiving and outputting the clock signal can be composed in a simpler structure than that of the flip-flop, the circuit scale of the shift register will be much smaller than the conventional configuration with the twice-scale shift register.

Accordingly, for performing pre-charging of a signal supplying line with an internal pre-charging circuit by using a pre-charging power source having small driving ability, the foregoing configuration can provide a driver circuit of a display- device capable of preventing fluctuation of a signal supplied to a different signal supplying line, while keeping the circuit scale of the shift register small.

Further, as described, the driver circuit for a display device according to the present invention may be arranged so that the first switches sequentially become conductive by the timing pulse from the flip-flops, and a number of the switch circuits corresponds to the number of the signal supplying lines so as to sequentially bring the second switches into conduction.

When performing pre-charging of a signal supplying line with an internal pre-charging circuit having a switch circuit for controlling point-at-a-time conduction to the signal supplying line by using a pre-charging power source having small driving ability, in a driver circuit using a so-called point-at-a-time driving method in which writing is sequentially carried out with respect to the respective signal supplying lines by a timing pulse supplied from a flip-flop, the foregoing arrangement can provide a driver circuit of a display device capable of preventing fluctuation of a signal supplied to a different signal supplying line, while keeping the circuit scale of the shift register small.

Further, as described, the driver circuit for a display device according to the present invention may be arranged so that the first switches sequentially become conductive in units of i (i being an integer not less than 2) signal supplying lines, and the first switches included in each of the units of i signal supplying lines simultaneously become conductive, by the timing pulse from the flip-flops, and a number of the switch circuits corresponds to a number of the units, and the second switches sequentially become conductive in the units, and the second switches included in each of the units simultaneously become conductive.

When performing pre-charging of a signal supplying line with an internal pre-charging circuit having a switch circuit for controlling simultaneous multipoint conduction to the signal supplying line by using a pre-charging power source having small driving ability, in a driver circuit using a so-called simultaneous multipoint driving method in which writing is sequentially carried out with respect to a set of plural signal supplying lines by a timing pulse supplied from a flip-flop, the foregoing arrangement can provide a driver circuit of a display device capable of preventing fluctuation of a signal supplied to a different signal supplying line, while keeping the circuit scale of the shift register small.

Further, as described, the driver circuit for a display device according to the present invention may be arranged so that the flip-flops are set-reset flip-flops, and the control signal supplying circuits are level shift circuits for performing level shift of the clock signal, and for outputting the clock signal after the level shift as the pre-charging control signal, and the level shift circuits output the clock signal after the level shift also as a set signal transferred to a set-reset flip-flop next to a set-reset flip-flop outputting the timing pulse, and the set-reset flip-flops use the set signal as a reset signal of a preceding set-reset flip-flop.

Namely, as described, the driver circuit for a display device according to the present invention includes: a writing circuit having a plurality of first switches for each of the signal supplying lines so as to carry out writing of a write signal into the signal supplying lines by bringing the first switches into conduction, the first switches being controlled between a conductive state and a non-conductive state according to a voltage of a first control terminal which is capacitive; a shift register having a plural stages of flip-flops for outputting a timing pulse used for the writing toward the first control terminal so that the timing pulse is sequentially transferred through the flip-flops so as to carry out the writing at predetermined cycles; and a pre-charging circuit having a plurality of second switches for each of the signal supplying lines so as to carry out pre-charging of the signal supplying lines by bringing the second switches into conduction, the second switches being controlled between a conductive state and a non-conductive state according to a voltage of a second control terminal which is capacitive, wherein: the flip-flops are set-reset flip-flops, and the shift register includes a level shift circuit which brings the second switches into conduction upon input of the timing pulse from the set-reset flip-flop in a writing effective period, which is a period for carrying out the writing during the predetermined cycle, by receiving the clock signal and carrying out level shift of the clock signal before outputting the clock signal to the control terminal of the second switch corresponding to a predetermined one of the signal supplying lines which is not subjected to the writing, and the control signal supplying circuits are provided according to the number of the signal supplying lines pre-charged in the writing effective period, and each of the switch circuits outputs the clock signal also as a set signal transferred to a set-reset flip-flop next to the set-reset flip-flop outputting the timing pulse, and the set-reset flip-flop uses the set signal as a reset signal of a preceding set-reset flip-flop of the set-reset flip-flop.

With this arrangement, the first switch of the writing circuit becomes conductive when the control terminal is charged by the output of the timing pulse for writing a write signal from the set-reset flip-flop, and meanwhile, the second switch of the writing circuit becomes conductive when the control terminal is charged by the receive and output of the clock signal, which is supplied from a different source from that of the timing pulse, by the switch circuit. The writing is sequentially carried out with respect to the respective signal supplying lines in the writing effective period, and when the set-reset flip-flop outputs a timing pulse, the level shift circuit is supplied with the timing pulse from the set-reset flip-flop of the preceding stage, and receives a clock signal and carries out level shift of the clock signal and outputs the clock signal, so as to carry out pre-charging of the signal supplying lines which is not subjected to the writing.

Further, each of the level shift circuits outputs the received clock signal as a set signal transferred to a set-reset flip-flop next to the set-reset flip-flop which has been supplied with the timing pulse, and each of the set-reset flip-flops uses the supplied set signal as a reset signal of the preceding set-reset flip-flop. As a result, the timing pulse may be sequentially transferred.

As described, the foregoing arrangement allows writing of a write signal into a part of the signal supplying lines by the writing circuit, while carrying out pre-charging of a different part of the signal supplying lines. Further, here, the system for supplying the timing pulse used for the writing is separated from the system for supplying the pre-charging control signal. Thus, the control signal circuit of the first switch and the control circuit of the second switch are not provided as one circuit. On this account, it is possible to prevent such a phenomenon that a large current flowing into the signal supplying line upon the pre-charging causes fluctuation of the potential of the write signal of the signal supplying line subjected to writing at the time, via the capacitive control terminal of the switch. Further, since the switch circuit for receiving and outputting the clock signal can be composed in a simpler structure than that of the flip-flop, the circuit scale of the shift register will be much smaller than the conventional configuration with the twice-scale shift register.

Accordingly, for performing pre-charging of a signal supplying line with an internal pre-charging circuit by using a pre-charging power source having small driving ability, the foregoing configuration can provide a driver circuit of a display device capable of preventing fluctuation of a signal supplied to a different signal supplying line, while keeping the circuit scale of the shift register small.

Further, as it may be recognized with the foregoing arrangement using a low voltage signal as the clock signal supplied to the level shift circuit, the level shift circuit has a function as a low voltage interface, thereby reducing power consumption of the external circuit which generates the clock signal.

Further, as described, the driver circuit for a display device according to the present invention may be arranged so that the first switches sequentially become conductive by the timing pulse from the flip-flops, and a number of the level shift circuits corresponds to the number of the signal supplying lines so as to sequentially bring the second switches into conduction.

When performing pre-charging of a signal supplying line with an internal pre-charging circuit having a level shift circuit for controlling point-at-a-time conduction to the signal supplying line by using a pre-charging power source having small driving ability, in a driver circuit using a so-called, point-at-a-time driving method in which writing is sequentially carried out with respect to the respective signal supplying lines by a timing pulse supplied from a flip-flop, the foregoing arrangement can provide a driver circuit of a display device capable of preventing fluctuation of a signal supplied to a different signal supplying lines, while keeping the circuit scale of the shift register small.

Further, as described, the driver circuit for a display device according to the present invention may be arranged so that the first switches sequentially become conductive in units of i (i being an integer not less than 2) signal supplying lines, and the first switches included in each of the units of i signal supplying lines simultaneously become conductive, by the timing pulse from the flip-flops, and a number of the level shift circuits corresponds to a number of the units, and the second switches sequentially become conductive in the units, and the second switches included in each of the units simultaneously become conductive.

When performing pre-charging of a signal supplying line with an internal pre-charging circuit having a level shift circuit for controlling simultaneous multipoint conduction to the signal supplying line by using a pre-charging power source having small driving ability, in a driver circuit using a so-called simultaneous multipoint driving method in which writing is sequentially carried out with respect to a set of plural signal supplying lines by a timing pulse supplied from a flip-flop, the foregoing arrangement can provide a driver circuit of a display device capable of preventing fluctuation of a signal supplied to a different signal supplying lines, while keeping the circuit scale of the shift register small.

Further, as described, the driver circuit for a display device according to the present invention may be arranged so that a plural stages of flip-flops for outputting a timing pulse used for writing of a write signal into a plurality of signal supplying lines provided in a display device so that the timing pulse is sequentially transferred through the flip-flops so as to carry out the writing at predetermined cycles; and a plurality of control signal supplying circuits provided according to a number of the signal supplying lines pre-charged in the writing effective period, upon input of the timing pulse from the flip-flop in a writing effective period, which is a period for carrying out the writing during the predetermined cycle, the control signal supplying circuits bringing the second switches into conduction by receiving a clock signal supplied from a signal source different from a signal source for supplying the timing pulse, and outputting a pre-charging control signal synchronized with the clock signal for carrying out pre-charging of a predetermined one of the signal supplying lines which is not subjected to the writing.

Thus, in case of performing pre-charging of a signal supplying line with an internal pre-charging circuit by using a pre-charging power source having small driving ability, this arrangement can provide a shift register having a small circuit scale and is suitably used for a driver circuit for a display device capable of preventing fluctuation of a signal supplied to a different signal supplying line.

Further, as described, the driver circuit for a display device according to the present invention may be arranged so that the control signal supplying circuits are switch circuits for outputting the clock signal as the pre-charging control signal, and the control signal supplying circuits are switch circuits for outputting the clock signal as a pre-charging control signal for carrying out the pre-charging of a predetermined one of the signal supplying lines which is not subjected to the writing, and the switch circuits output the clock signal also as a set signal transferred to a set-reset flip-flop next to a set-reset flip-flop outputting the timing pulse, and the set-reset flip-flop uses the set signal as a reset signal of a preceding set-reset flip-flop.

Namely, as described, the driver circuit for a display device according to the present invention includes: a plural stages of flip-flops for outputting a timing pulse used for writing of a write signal into a plurality of signal supplying lines provided in a display device so that the timing pulse is sequentially transferred through the flip-flops so as to carry out the writing at predetermined cycles; and a plurality of switch circuits provided according to a number of the signal supplying lines pre-charged in the writing effective period, upon input of the timing pulse from the flip-flop in a writing effective period, which is a period for carrying out the writing during the predetermined cycle, the switch circuits receiving a clock signal supplied from a signal source different from a signal source for supplying the timing pulse, and outputting a pre-charging control signal synchronized with the clock signal for carrying out the pre-charging of a predetermined one of the signal supplying lines which is not subjected to the writing, and each of the switch circuits outputs the clock signal also as a set signal transferred to a set-reset flip-flop next to the set-reset flip-flop outputting the timing pulse, and the set-reset flip-flop uses the set signal as a reset signal of a preceding set-reset flip-flop of the set-reset flip-flop.

Therefore, in case of performing pre-charging of a signal supplying line with an internal pre-charging circuit by using a pre-charging power source having small driving ability, this arrangement can provide a shift register having a small circuit scale and is suitably used for a driver circuit for a display device capable of preventing fluctuation of a signal supplied to a different signal supplying line.

Further, as described, the driver circuit for a display device according to the present invention may be arranged so that the flip-flops are D flip-flops which use an output signal as an input signal of a next stage, the D flip-flop is supplied with a clock signal which is supplied from a signal source different from a signal source for supplying the timing pulse, and the control signal supplying circuits are switch circuits for outputting the clock signal as a pre-charging control signal for carrying out the pre-charging of a predetermined one of the signal supplying lines which is not subjected to the writing.

Namely, as described, the driver circuit for a display device according to the present invention includes: a plural stages of D flip-flops for outputting a timing pulse used for writing of a write signal into a plurality of signal supplying lines provided in a display device so that the timing pulse is sequentially transferred through the flip-flops so as to carry out the writing at predetermined cycles, the D flip-flop being supplied with a clock signal which is supplied from a signal source different from a signal source for supplying the timing pulse; and a plurality of switch circuits provided according to a number of the signal supplying lines pre-charged in the writing effective period, upon input of the timing pulse from the D flip-flop in a writing effective period, which is a period for carrying out the writing during the predetermined cycle, the switch circuits receiving the clock signal and outputting the clock signal as a pre-charging control signal for carrying out the pre-charging of a predetermined one of the signal supplying lines which is not subjected to the writing.

Thus, in case of performing pre-charging of a signal supplying line with an internal pre-charging circuit by using a pre-charging power source having small driving ability, this arrangement can provide a shift register having a small circuit scale and is suitably used for a driver circuit for a display device capable of preventing fluctuation of a signal supplied to a different signal supplying line.

Further, as described, the driver circuit for a display device according to the present invention may be arranged so that a number of the switch circuits corresponds to the number of the units.

Thus, when performing pre-charging of a signal supplying line with an internal pre-charging circuit having a switch circuit for controlling point-at-a-time conduction to the signal supplying line by using a pre-charging power source having small driving ability, the foregoing arrangement provides a shift register having a small circuit scale and suitably used for a driver circuit for a display device capable of preventing fluctuation of a signal supplied to a different signal supplying line.

Further, as described, the driver circuit for a display device according to the present invention may be arranged so that a number of the switch circuits corresponds to a number of units, each of which is made up of i (i being an integer not less than 2) signal supplying lines.

Thus, when performing pre-charging of a signal supplying line with an internal pre-charging circuit having a switch circuit for controlling simultaneous multipoint conduction to the signal supplying line by using a pre-charging power source having small driving ability, the foregoing arrangement provides a shift register having a small circuit scale and suitably used for a driver circuit for a display device capable of preventing fluctuation of a signal supplied to a different signal supplying line.

Further, as described, the driver circuit for a display device according to the present invention may be arranged so that the flip-flops are set-reset flip-flops, and the control signal supplying circuits are level shift circuits for performing level shift of the clock signal, and for outputting the clock signal after the level shift as the pre-charging control signal for carrying out the pre-charging of a predetermined one of the signal supplying lines which is not subjected to the writing, and the level shift circuits output the clock signal after the level shift also as a set signal transferred to a set-reset flip-flop next to the set-reset flip-flop outputting the timing pulse, and the set-reset flip-flop uses the set signal as a reset signal of a preceding set-reset flip-flop of the set-reset flip-flop.

Namely, as described, the driver circuit for a display device according to the present invention includes: a plural stages of set-reset flip-flops for outputting a timing pulse used for writing of a write signal into a plurality of signal supplying lines provided in a display device so that the timing pulse is sequentially transferred through the flip-flops so as to carry out the writing at predetermined cycles; and a plurality of level shift circuits provided according to a number of the signal supplying lines pre-charged in the writing effective period, upon input of the timing pulse from the set-reset flip-flop in a writing effective period, which is a period for carrying out the writing during the predetermined cycle, the level shift circuits receiving the clock signal supplied from a signal source different to a signal source for supplying the timing pulse, and carrying out level shift of the clock signal and then outputting the clock signal as a pre-charging control signal for carrying out the pre-charging of a predetermined one of the signal supplying lines which is not subjected to the writing, and the level shift circuits output the clock signal after the level shift also as a set signal transferred to a set-reset flip-flop next to the set-reset flip-flop outputting the timing pulse, and the set-reset flip-flop uses the set signal as a reset signal of a preceding set-reset flip-flop of the set-reset flip-flop.

Therefore, in case of performing pre-charging of a signal supplying line with an internal pre-charging circuit by using a pre-charging power source having small driving ability, this arrangement can provide a shift register having a small circuit scale and is suitably used for a driver circuit for a display device capable of preventing fluctuation of a signal supplied to a different signal supplying lines.

Further, as described, the driver circuit for a display device according to the present invention may be arranged so that a number of the level shift circuits corresponds to the number of the signal supplying lines.

Thus, when performing pre-charging of a signal supplying line with an internal pre-charging circuit having a level shift circuit for controlling point-at-a-time conduction to the signal supplying line by using a pre-charging power source having small driving ability, the foregoing arrangement provides a shift register having a small circuit scale and suitably used for a driver circuit for a display device capable of preventing fluctuation of a signal supplied to a different signal supplying line.

Further, as described, the driver circuit for a display device according to the present invention may be arranged so that a number of the level shift circuits corresponds to a number of units, each of which is made up of i (i being an integer not less than 2) signal supplying lines.

Thus, when performing pre-charging of a signal supplying line with an internal pre-charging circuit having a level shift circuit for controlling simultaneous multipoint conduction to the signal supplying line by using a pre-charging power source having small driving ability, the foregoing arrangement provides a shift register having a small circuit scale and suitably used for a driver circuit for a display device capable of preventing fluctuation of a signal supplied to a different signal supplying lines.

Further, as described, a display device according to the present invention includes: a plurality of pixels; a plurality of data signal lines as signal supplying lines and a plurality of scanning signal lines as signal supplying lines; a data signal line driver for writing a video signal as a write signal with respect to the data signal lines and the pixels; and a scanning signal line driver for writing a scanning signal as a write signal to the scanning signal lines so as to select a pixel to which the video signal is written, wherein the data signal line driver operates to be one of the foregoing driver circuits for a display device.

With this arrangement, when a data signal line driver performs pre-charging of a signal supplying line with an internal pre-charging circuit by using a pre-charging power source having small driving ability, the foregoing configuration can provide a driver circuit of a display device capable of preventing fluctuation of a signal supplied to a different signal supplying line, while keeping the circuit scale of the shift register small. As a result, display uniformity is ensured in the display device, thus providing a display device having high display quality.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A driver circuit for a display device including a plurality of signal supplying lines, comprising:

a writing circuit having a plurality of first switches for each of the signal supplying lines so as to carry out writing of a write signal into the signal supplying lines by bringing the first switches into conduction, the first switches being controlled between a conductive state and a non-conductive state according to a voltage of a first control terminal which is capacitive;

a shift register having a plural stages of flip-flops for outputting a timing pulse used for the writing toward the first control terminal so that the timing pulse is sequentially transferred through the flip-flops so as to carry out the writing at predetermined cycles; and a pre-charging circuit having a plurality of second switches for each of the signal supplying lines so as to carry out pre-charging of the signal supplying lines by bringing the second switches into conduction, the second switches being controlled between a conductive state and a non-conductive state according to a voltage of a second control terminal which is capacitive, while the writing is carried out into a part of the signal supplying lines, the pre-charging circuit carrying out the pre-charging of at least one of remaining signal supplying lines, the shift register including control signal supplying circuits which output a pre-charging control signal for controlling the second switches to the second control terminal via a second signal line which is separated from a first signal line which transmits the timing pulse to the first control terminal.

2. The driver circuit as set forth in claim 1, wherein:

upon input of the timing pulse from the flip-flop in a writing effective period, which is a period for carrying out the writing during the predetermined cycle, the control signal supplying circuits bring the second switches into conduction by receiving a clock signal supplied from a signal source different from a signal source for supplying the timing pulse, and outputting a pre-charging control signal synchronized with the clock signal to the second control terminal corresponding to a predetermined one of the signal supplying lines which is not subjected to the writing, and the control signal supplying circuits are provided according to a number of the signal supplying lines pre-charged in the writing effective period.

3. The driver circuit as set forth in claim 2, wherein:

the flip-flops are set-reset flip-flops, and the control signal supplying circuits are switch circuits for outputting the clock signal as the pre-charging control signal, and each of the switch circuits outputs the clock signal also as a set signal transferred to a set-reset flip-flop next to the set-reset flip-flop outputting the timing pulse, and the set-reset flip-flop uses the set signal as a reset signal of a preceding set-reset flip-flop of the set-reset flip-flop.

4. The driver circuit as set forth in claim 3, wherein:

the first switches sequentially become conductive by the timing pulse from the flip-flops, and a number of the switch circuits corresponds to the number of the signal supplying lines so as to sequentially bring the second switches into conduction.

5. The driver circuit as set forth in claim 3, wherein:

the first switches sequentially become conductive in units of i (i being an integer not less than 2) signal supplying lines, and the first switches included in each of the units of i signal supplying lines simultaneously become conductive, by the timing pulse from the flip-flops, and a number of the switch circuits corresponds to a number of the units, and the second switches sequentially become conductive in the units, and the second switches included in each of the units simultaneously become conductive.

6. The driver circuit as set forth in claim 2, wherein:

the flip-flops are D flip-flops which use an output signal as an input signal of a next stage, the D flip-flop is supplied with a clock signal which is supplied from a signal source different from a signal source for supplying the timing pulse, and the control signal supplying circuits are switch circuits for outputting the clock signal as the pre-charging control signal.

7. The driver circuit as set forth in claim 6, wherein:

the first switches sequentially become conductive by the timing pulse from the flip-flops, and a number of the switch circuits corresponds to the number of the signal supplying lines so as to sequentially bring the second switches into conduction.

8. The driver circuit as set forth in claim 6, wherein:

the first switches sequentially become conductive in units of i (i being an integer not less than 2) signal supplying lines, and the first switches included in each of the units of i signal supplying lines simultaneously become conductive, by the timing pulse from the flip-flops, and a number of the switch circuits corresponds to a number of the units, and the second switches sequentially become conductive in the units, and the second switches included in each of the units simultaneously become conductive.

9. The driver circuit as set forth in claim 2, wherein:

the flip-flops are set-reset flip-flops, and the control signal supplying circuits are level shift circuits for performing level shift of the clock signal, and for outputting the clock signal after the level shift as the pre-charging control signal, and each of the level shift circuits outputs the clock signal after the level shift also as a set signal transferred to a set-reset flip-flop.next to the set-reset flip-flop outputting the timing pulse, and the set-reset flip-flop uses the set signal as a reset signal of a preceding set-reset flip-flop of the set-reset flip-flop.

10. The driver circuit as set forth in claim 9, wherein:

the first switches sequentially become conductive by the timing pulse from the flip-flops, and a number of the level shift circuits corresponds to the number of the signal supplying lines so as to sequentially bring the second switches into conduction.

11. The driver circuit as set forth in claim 9, wherein:

the first switches sequentially become conductive in units of i (i being an integer not less than 2) signal supplying lines, and the first switches included in each of the units of i signal supplying lines simultaneously become conductive, by the timing pulse from the flip-flops, and a number of the level shift circuits corresponds to a number of the units, and the second switches sequentially become conductive in the units, and the second switches included in each of the units simultaneously become conductive.

12. A shift register, comprising:

a plural stages of flip-flops for outputting a timing pulse used for writing of a write signal into a plurality of signal supplying lines provided in a display device so that the timing pulse is sequentially transferred through the flip-flops so as to carry out the writing at predetermined cycles; and a plurality of control signal supplying circuits provided according to a number of the signal supplying lines pre-charged in the writing effective period, upon input of the timing pulse from the flip-flop in a writing effective period, which is a period for carrying out the writing during the predetermined cycle, the control signal supplying circuits receiving a clock signal supplied from a signal source different from a signal source for supplying the timing pulse, and outputting a pre-charging control signal synchronized with the clock signal for carrying out pre-charging of a predetermined one of the signal supplying lines which is not subjected to the writing.

13. The driver circuit as set forth in claim 12, wherein:

the flip-flops are set-reset flip-flops, and the control signal supplying circuits are switch circuits for outputting the clock signal as the pre-charging control signal, and the control signal supplying circuits are switch circuits for outputting the clock signal as a pre-charging control signal for carrying out the pre-charging of a predetermined one of the signal supplying lines which is not subjected to the writing, and each of the switch circuits outputs the clock signal also as a set signal transferred to a set-reset flip-flop next to the set-reset flip-flop outputting the timing pulse, and the set-reset flip-flop uses the set signal as a reset signal of a preceding set-reset flip-flop of the set-reset flip-flop.

14. The driver circuit as set forth in claim 13, wherein: a number of the switch circuits corresponds to the number of the signal supplying lines.

15. The driver circuit as set forth in claim 13, wherein: a number of the switch circuits corresponds to a number of units, each of which is made up of i (i being an integer not less than 2) signal supplying lines.

16. The driver circuit as set forth in claim 12, wherein:

the flip-flops are D flip-flops which use an output signal as an input signal of a next stage, the D flip-flop is supplied with a clock signal which is supplied from a signal source different from a signal source for supplying the timing pulse, and the control signal supplying circuits are switch circuits for outputting the clock signal as a pre-charging control signal for carrying out the pre-charging of a predetermined one of the signal supplying lines which is not subjected to the writing.

17. The driver circuit as set forth in claim 11, wherein: a number of the switch circuits corresponds to the number of the units.

18. The driver circuit as set forth in claim 16, wherein: a number of the switch circuits corresponds to a number of units, each of which is made up of i (i being an integer not less than 2) signal supplying lines.

19. The driver circuit as set forth in claim 12, wherein:

the flip-flops are set-reset flip-flops, and the control signal supplying circuits are level shift circuits for performing level shift of the clock signal, and for outputting the clock signal after the level shift as the pre-charging control signal for carrying out the pre-charging of a predetermined one of the signal supplying lines which is not subjected to the writing, and the level shift circuits output the clock signal after the level shift also as a set signal transferred to a set-reset flip-flop next to the set-reset flip-flop outputting the timing pulse, and the set-reset flip-flop uses the set signal as a reset signal of a preceding set-reset flip-flop of the set-reset flip-flop.

20. The driver circuit as set forth in claim 19, wherein: a number of the level shift circuits corresponds to the number of the signal supplying lines.

21. The driver circuit as set forth in claim 19, wherein: a number of the level shift circuits corresponds to a number of units, each of which is made up of i (i being an integer not less than 2) signal supplying lines.

22. A display device, comprising:

a plurality of pixels;

a plurality of data signal lines as signal supplying lines and a plurality of scanning signal lines as signal supplying lines;

a data signal line driver for writing a video signal as a writesignal to the data signal lines and the pixels; and a scanning signal line driver for writing a scanning signal as a write signal to the scanning signal lines so as to select a pixel to which the video signal is written, the data signal line driver including:

a writing circuit, which is a driver circuit for a display device including a plurality of signal supplying lines, the writing circuit having a plurality of first switches for each of the signal supplying lines so as to carry out writing of a write signal into the signal supplying lines by bringing the first switches into conduction, the first switches being controlled between a conductive state and a non-conductive state according to a voltage of a first control terminal which is capacitive;

a shift register having a plural stages of flip-flops for outputting a timing pulse used for the writing toward the first control terminal so that the timing pulse is sequentially transferred through the flip-flops so as to carry out the writing at predetermined cycles; and a pre-charging circuit having a plurality of second switches for each of the signal supplying lines so as to carry out pre-charging of the signal supplying lines by bringing the second switches into conduction, the second switches being controlled between a conductive state and a non-conductive state according to a voltage of a second control terminal which is capacitive, while the writing is carried out with respect to a part of the signal supplying lines, the pre-charging circuit carrying out the pre-charging of at least one of remaining signal supplying lines, the shift register including control signal supplying circuits which output a pre-charging control signal for controlling the second switches to the second control terminal via a second signal line which is separated from a first signal line which transmits the timing pulse to the first control terminal.

23. The driver circuit as set forth in claim 16 wherein:

a number of the switch circuits corresponds to the number of the units.

24. A liquid crystal display device including the drive circuit of claim 1, and a plurality of pixels driven by the drive circuit.

25. A liquid crystal display device including a drive circuit including the shift register of claim 12, and a plurality of pixels driven by the drive circuit.

* * * * *

UNITED STATES PATENT AND TRADEMARK OFFICE

CERTIFICATE OF CORRECTION

PATENT NO. : 7,274,351 B2
APPLICATION NO. : 10/446149
DATED : September 25, 2007
INVENTOR(S) : Washio et al.

It is certified that error appears in the above-identified patent and that said Letters Patent is hereby corrected as shown below:

(*) Notice: On the title page insert

Add --This patent is subject to a Terminal Disclaimer--.

Signed and Sealed this

Twenty-fifth Day of March, 2008

JON W. DUDAS
*Director of the United States Patent and Trademark Office*